US012474140B2

(12) United States Patent
Angers, Jr.

(10) Patent No.: US 12,474,140 B2
(45) Date of Patent: Nov. 18, 2025

(54) FORWARD CHARGING HANDLE FOR FIREARM AND METHOD THEREFORE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 0 days.

(21) Appl. No.: 18/670,909

(22) Filed: May 22, 2024

(65) Prior Publication Data

US 2024/0310143 A1 Sep. 19, 2024

Related U.S. Application Data

(63) Continuation-in-part of application No. 17/886,277, filed on Aug. 11, 2022, now Pat. No. 12,196,527.

(51) Int. Cl.

| | |
|---|---|
| ***F41C 7/02*** | (2006.01) |
| ***F41A 3/72*** | (2006.01) |
| ***F41C 23/16*** | (2006.01) |

(52) U.S. Cl.

CPC ..... *F41C 7/02* (2013.01); *F41A 3/72* (2013.01); *F41C 23/16* (2013.01)

(58) Field of Classification Search

CPC ..... F41A 3/72; F41C 7/02

See application file for complete search history.

(56) References Cited

U.S. PATENT DOCUMENTS

| | | | | |
|---|---|---|---|---|
| 4,406,080 | A * | 9/1983 | Badali | F41C 7/02 42/75.01 |
| 7,231,861 | B1 * | 6/2007 | Gauny | F41A 3/72 89/1.4 |
| D590,473 | S * | 4/2009 | Fitzpatrick | F41A 3/72 D22/103 |
| 8,156,854 | B2 * | 4/2012 | Brown | F41A 3/72 89/1.4 |
| 9,347,737 | B2 * | 5/2016 | Troy | F41C 7/02 |
| 9,638,481 | B1 * | 5/2017 | Marano | F41A 3/72 |
| 10,113,830 | B2 * | 10/2018 | Monveldt | F41A 35/06 |
| 10,254,060 | B2 * | 4/2019 | Hoon | F41A 3/66 |
| 10,393,456 | B1 * | 8/2019 | Beardsley | F41A 3/72 |
| 10,598,451 | B1 * | 3/2020 | Haidu | F41A 3/72 |
| 10,677,547 | B2 * | 6/2020 | Cox | F41C 7/02 |
| 11,112,199 | B2 * | 9/2021 | Pizano | F41A 19/47 |

(Continued)

*Primary Examiner* — Gabriel J. Klein

(74) *Attorney, Agent, or Firm* — JOSEPH T REGARD LTD PLC

(57) ABSTRACT

A device and method for charging an automatic or semi-automatic firearm, via a unique forward charging handle configuration. The present invention is illustrated and for use on the AR-15 rifle platform, but is equally applicable to various other caliber and configured firearms, with or without gas tubes. The forward charging handle slidably reciprocates about and along the frontal support or hand guard area (also referenced as the fore stock) in a pump action, allowing ejecting of spent, jammed or dud ammo from the chamber area, or initial chambering or charging the firearm while maintaining shooting position. The present invention is particularly suitable for use in competitive shooting, military applications, hunting, etc, allowing the user to charge, chamber, and/or unjam the firearm while maintaining firing posture, without the need for the user's hand leaving the front support.

11 Claims, 21 Drawing Sheets

(56) References Cited

U.S. PATENT DOCUMENTS

| | | | | |
|---|---|---|---|---|
| 2007/0199435 | A1* | 8/2007 | Hochstrate | F41A 5/26 42/72 |
| 2010/0000400 | A1* | 1/2010 | Brown | F41G 1/02 42/111 |
| 2012/0042769 | A1* | 2/2012 | Makayama | F41A 3/72 89/1.4 |
| 2012/0152104 | A1* | 6/2012 | Audibert | F41A 5/24 89/191.01 |
| 2014/0060294 | A1* | 3/2014 | Brown | F41A 7/00 89/1.4 |
| 2014/0068988 | A1* | 3/2014 | Donahue | F41A 3/72 42/69.01 |
| 2015/0089854 | A1* | 4/2015 | Findlay | F41A 3/38 42/20 |
| 2015/0113848 | A1* | 4/2015 | Monveldt | F41A 35/06 42/16 |
| 2016/0047614 | A1* | 2/2016 | Larson, Jr. | F41G 11/003 89/191.01 |
| 2016/0209166 | A1* | 7/2016 | Larson, Jr. | F41A 35/06 |
| 2016/0349001 | A1* | 12/2016 | Troy | F41A 35/06 |
| 2017/0067715 | A1* | 3/2017 | Conant | F41A 3/66 |
| 2018/0142975 | A1* | 5/2018 | Hoon | F41A 3/66 |
| 2018/0195820 | A1* | 7/2018 | Noonan | F41C 23/16 |
| 2019/0154382 | A1* | 5/2019 | Pizano | F41A 19/47 |
| 2019/0212081 | A1* | 7/2019 | Cox | F41C 7/02 |
| 2019/0257601 | A1* | 8/2019 | Brown | F41A 3/84 |
| 2019/0316859 | A1* | 10/2019 | Kling | F41A 3/72 |
| 2020/0080802 | A1* | 3/2020 | Jennings | F41A 3/72 |
| 2022/0196354 | A1* | 6/2022 | Nedev | F41A 5/18 |
| 2024/0255252 | A1* | 8/2024 | Farris | F41C 23/16 |
| 2024/0310143 | A1* | 9/2024 | Angers, Jr. | F41A 3/72 |

* cited by examiner

FORWARD CHARGING HANDLE FOR FIREARM AND METHOD THEREFORE

CROSS REFERENCE TO RELATED APPLICATIONS

The present application is a continuation-in-part of U.S. patent application Ser. No. 17/886,277 filed Aug. 11, 2022 listing John W Angers, Jr as inventor, entitled "Forward Charging Handle for Firearm and Method Therefore". The foregoing application is incorporated by reference as if fully set forth herein.

GENERAL FIELD OF THE INVENTION

The present invention relates to devices and methods for charging an automatic or semi-automatic firearm, via a unique forward charging handle configuration. The present invention is illustrated for use on the AR-15 rifle platform, but is equally applicable to various other caliber and configured, as well as firearms with or without gas tubes. The forward charging handle slidably reciprocates about and along the frontal support or hand guard area (also referenced as the fore stock) in a pump action, to facilitate ejection of spent, jammed or dud ammo from the chamber area, or initial chambering or charging the firearm while maintaining shooting position. The present invention is particularly suitable for use in competitive shooting, military applications, hunting, law enforcement, etc, allowing the user to charge, chamber, and/or unjam the firearm while maintaining firing posture, without the need for the user's hand leaving the front support.

GENERAL BACKGROUND

Semi-Automatic and automatic firearms having longitudinally reciprocating bolts such as (but not limited to) AR-15's, M-16's or the like generally require a charging mechanism to initially chamber a load from the magazine to the firing chamber, or clear a miss-fire, failure to fully recoil after firing, or jam, generally in the form of the charging handle configured to retract the bolt carrier assembly, with the first end comprising a handle situated at the rear of the upper receiver, and a second end engaging the bolt carrier assembly.

In use, the user is required to grasp the handle and pull same to retract the bolt carrier assembly fully retracted from the chamber, then release so that spring bias urges the bolt carrier forward. The retraction removes any shell casing (or unspent round) from the chamber and, if a magazine with ammo is in place, such an action can be used to chamber a round.

While this typical charging handle configuration can be effective to charge the firearm, its position and use can be less than ideal, as it can be difficult if not impossible to accomplish while maintaining firing posture. Typically, in use, the user would have to lower the firearm from firing position to a charging position, at which point one would, for example, ungrip the forward stock or hand guard to grasp the charging handle, and, with the other hand grasping the carry handle, grip, or rear stock, etc, depending on the configuration, pull the charge handle, then, once charged, reposition from the charging position back to the firing position.

Accordingly, if during use the firearm requires charging, for example due to failure to fully recoil after firing, or jamming, dud, or incomplete cycling of spent ammo, manually charging via the above discussed system can result in a significant interruption of use due to required repositioning from the firing position to the charging position, then back to the firing position. This delay could endanger one using the firearm for protection or in a military or law enforcement capacity, or result in significant performance loss in a competitive shooting, or hunting scenario.

GENERAL SUMMARY DISCUSSION OF THE INVENTION

Unlike the prior charging systems, which generally provided a rearwardly-situated charging handle, the present invention provides a unique, forward charging handle configuration, wherein there is provided a forward charging handle assembly configured to slidably engage about and reciprocate along the frontal support or hand guard area (also referenced as the fore stock) so as to provide a pump action to fully recoil the bolt to facilitate ejection of spent, jammed or dud ammo from the chamber area, or facilitate initial chambering or charging the firearm, all the while maintaining shooting position.

The present invention thereby provides a significant reduction in time and effort spent charging the firearm with nominal interruption of ability to maintain firing position, which proves particularly suitable for use where time is of the essence such as competitive shooting, military or law enforcement operations, hunting, etc, with the user able to charge, chamber, and/or unjam the firearm while maintaining firing posture, in a fraction of the time required for conventional systems, and without the need for the user's hand to ungrip the front support.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 1 is an exploded, forward perspective view of the forward charging unit for gas operated carbines of the present invention requiring a gas tube, the illustrated configuration particularly suitable for use with AR-15 style rifles or the like.

FIG. 8 is an exploded, forward perspective view of an alternative forward charging unit of the present invention, the illustrated embodiment particularly suitable for use with a pistol caliber carbine or the like.

FIG. 15 is an exploded, forward perspective view of a second embodiment of a forward charging unit for gas operated carbines of the present invention requiring a gas tube, the illustrated configuration particularly suitable for use with AR-15 style rifles or the like.

DETAILED DISCUSSION OF THE INVENTION

Figure 1:
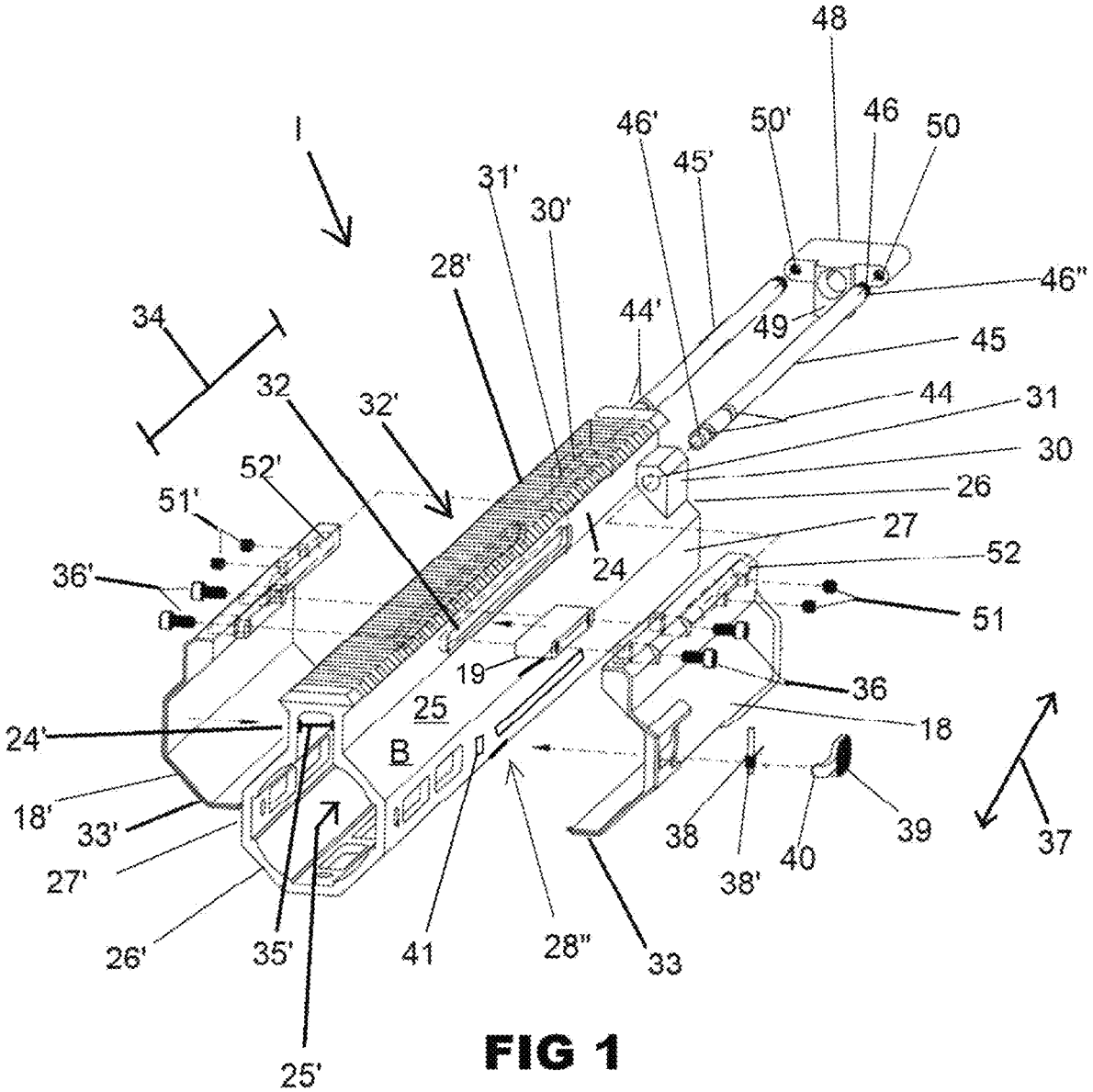
Figure 2:
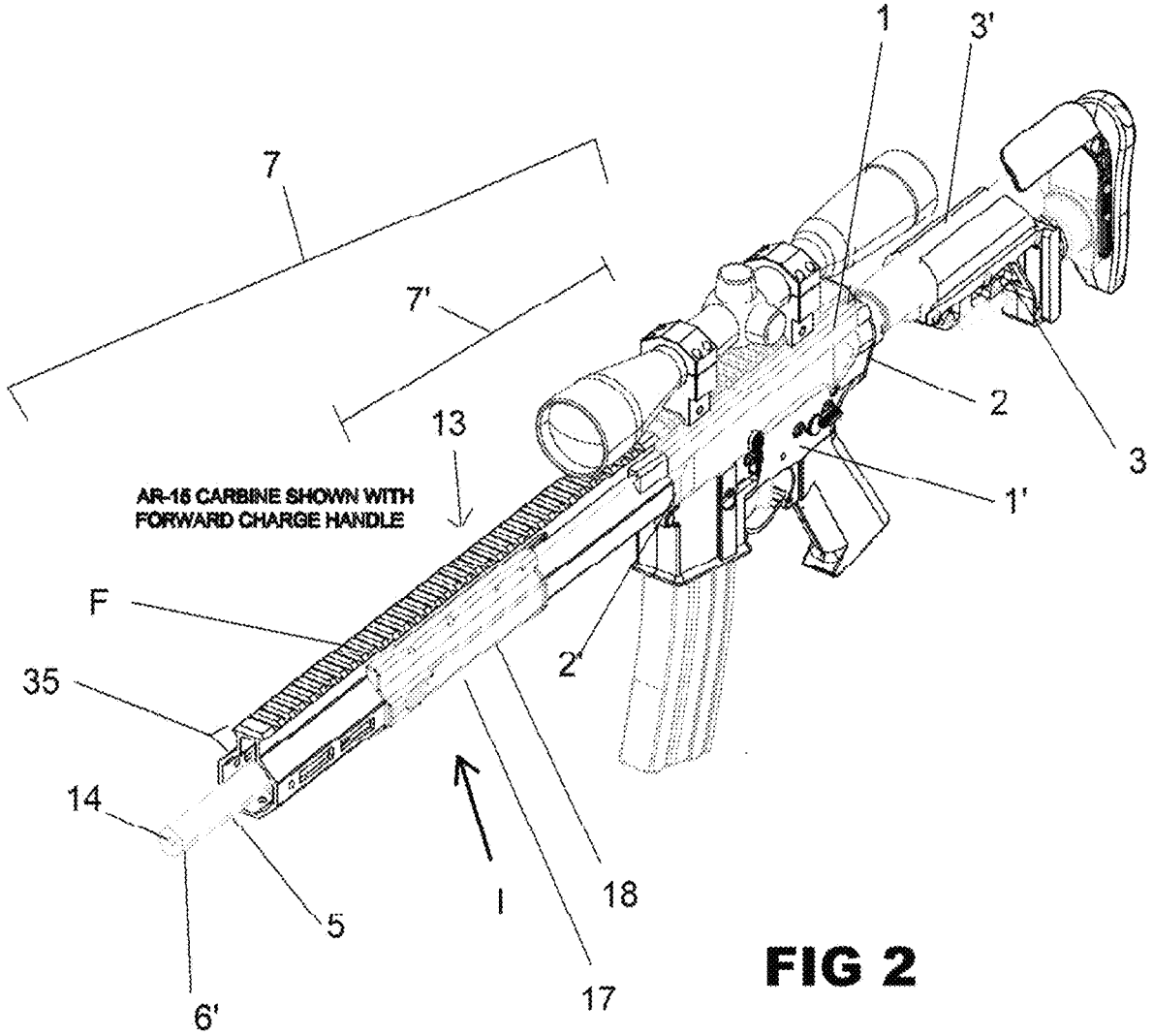
FIG. 2 is a forward, perspective view of the invention of FIG. 1, as applied to an AR-15 rifle.
Figure 3:
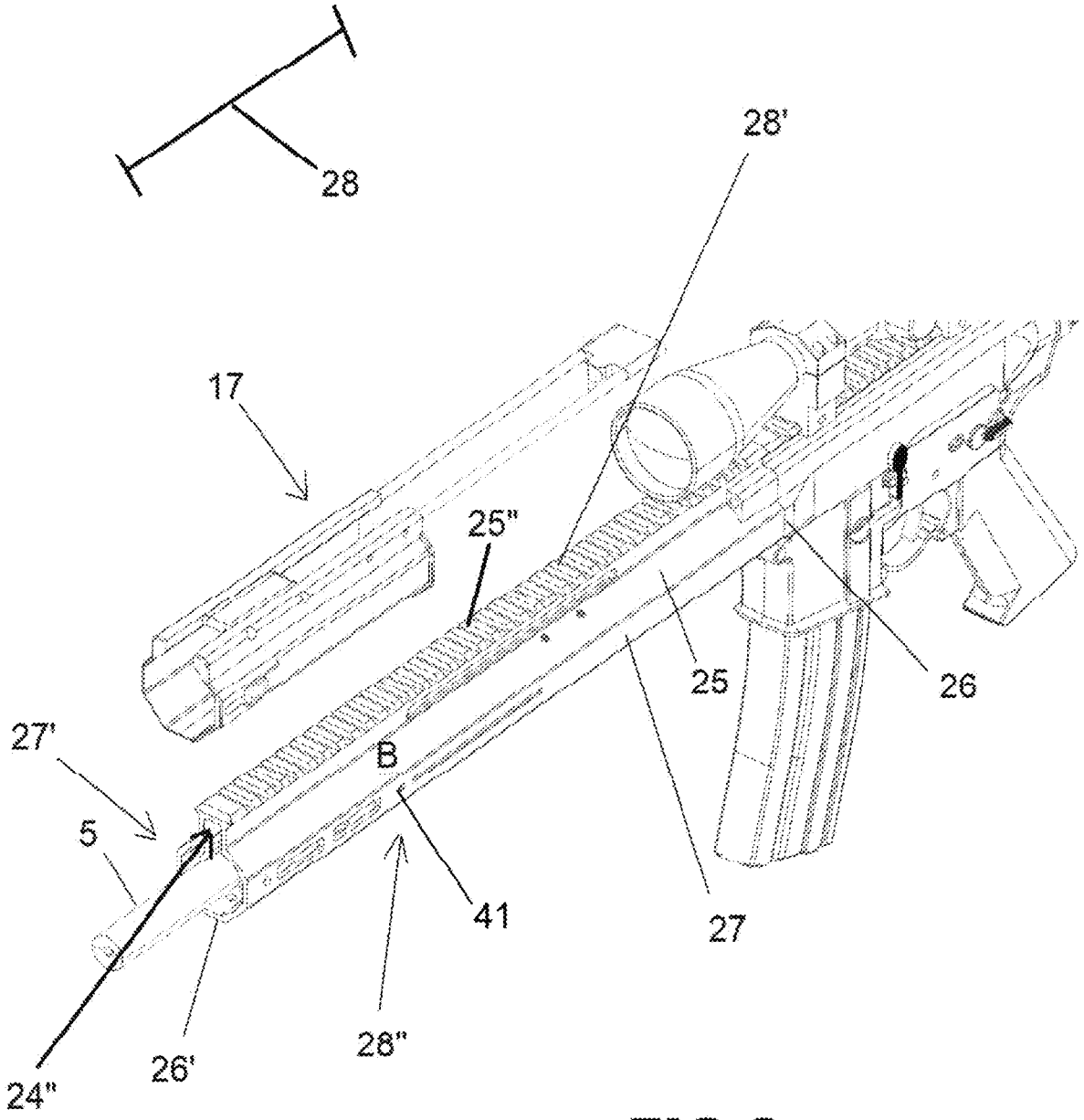
FIG. 3 is a forward, partial, perspective view of the invention of FIG. 2 illustrating the handguard applied to the AR-15 with the charging handle, drive stem and BCG catch of the present invention illustrated separately prior to installation.
Figure 4:
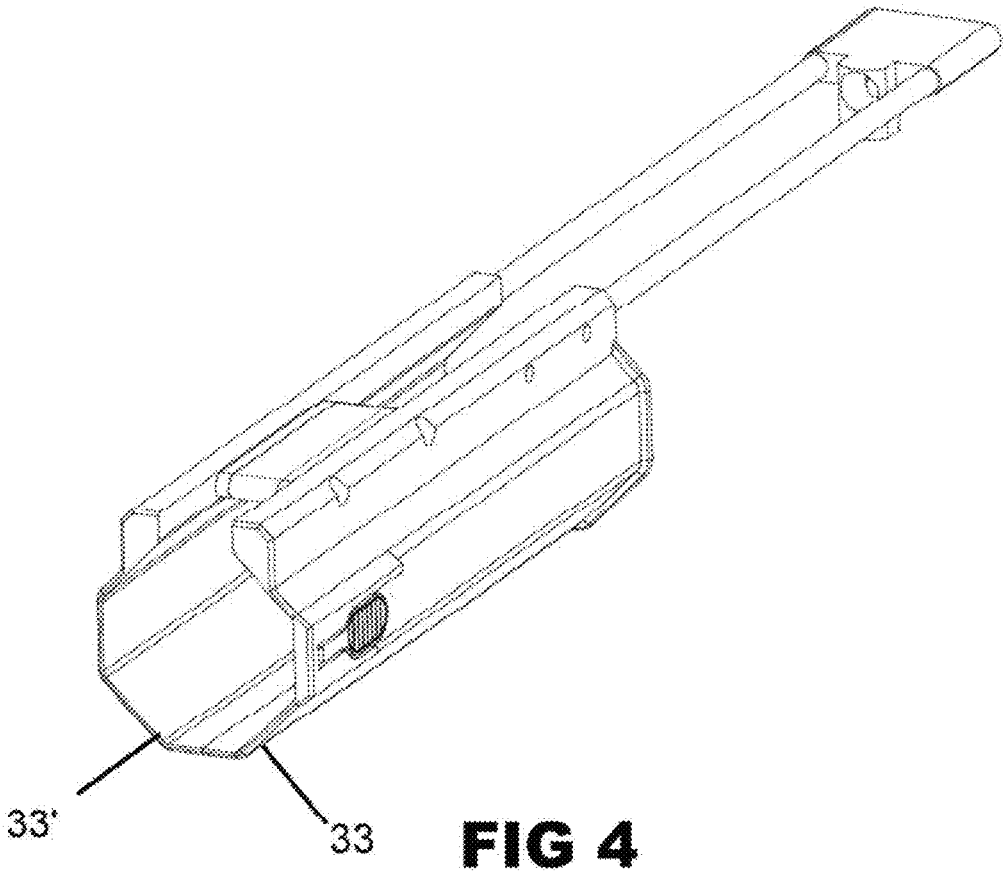
FIG. 4 is a forward, perspective view of the charging handle, drive stem and BCG catch of the invention of FIG. 3, shown in assembled form.
Figure 5:
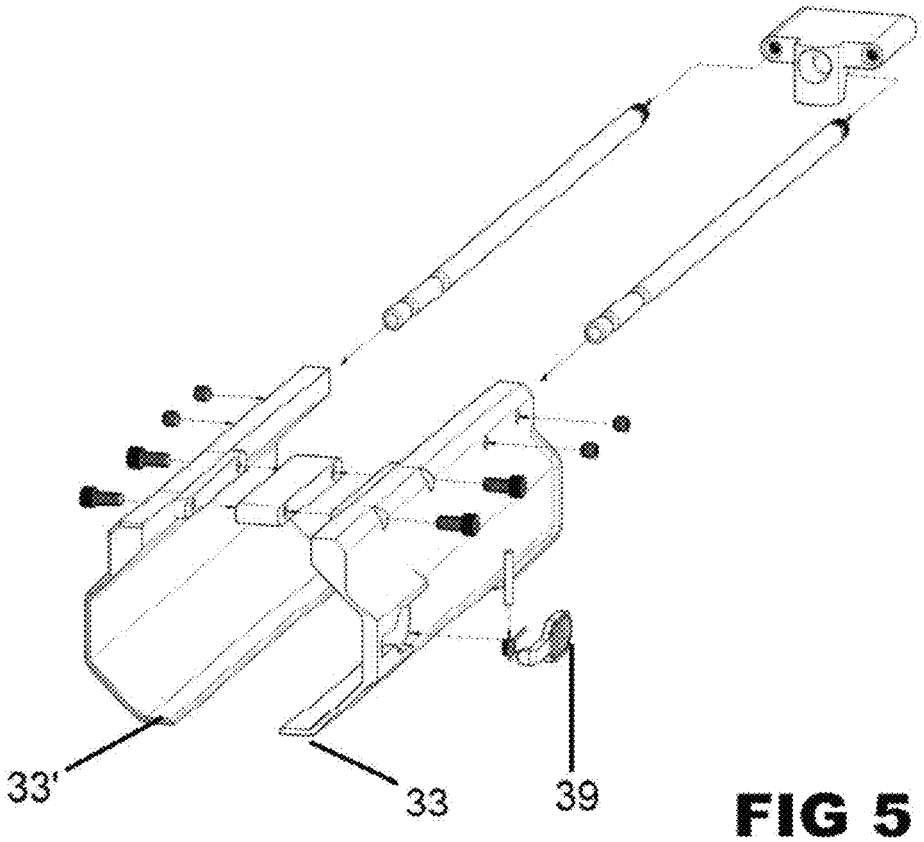
FIG. 5 is a forward, perspective, exploded view of the invention of FIG. 4.
Figure 6:
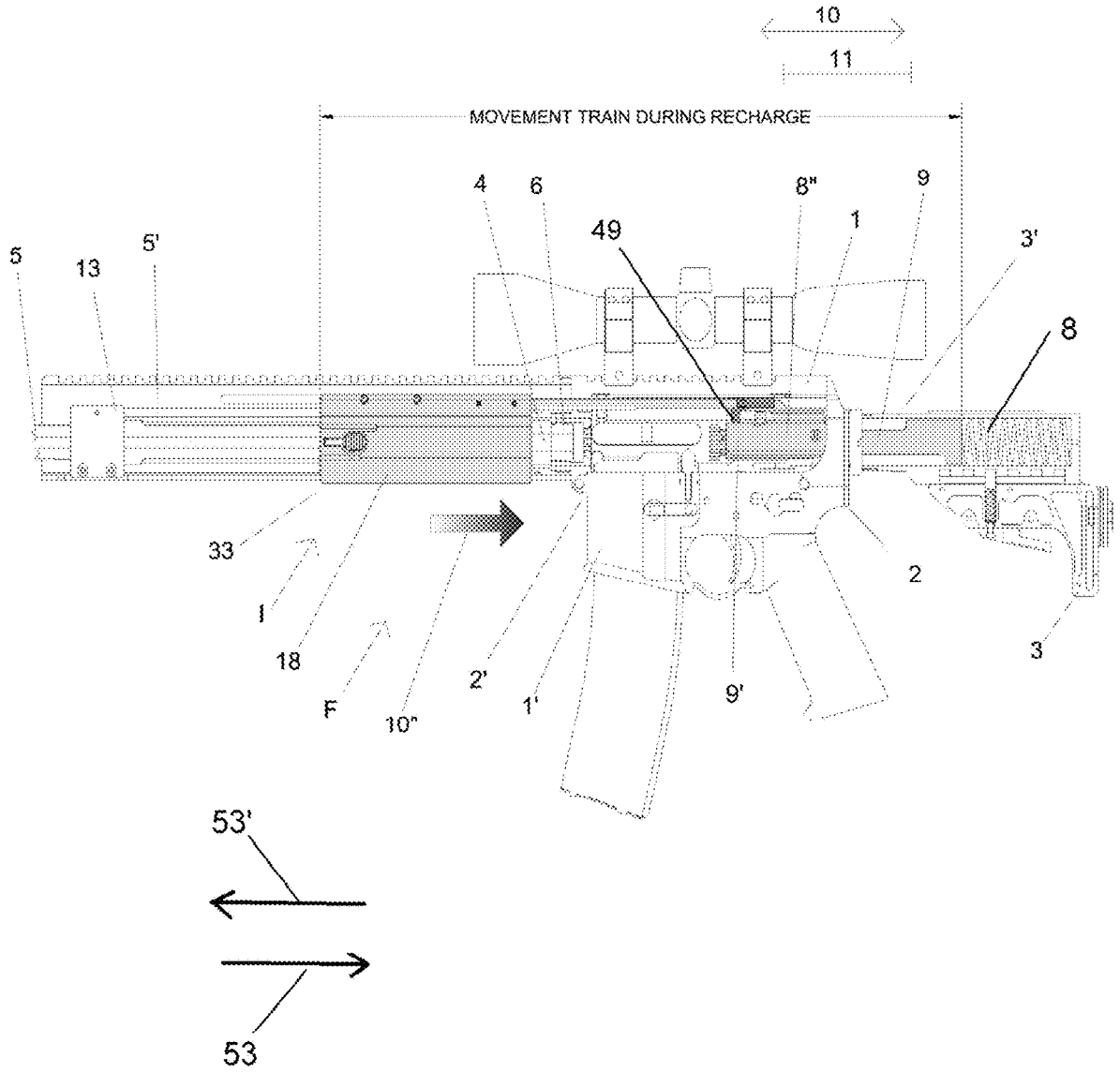
FIG. 6 is a side view of the invention of FIG. 3 in assembled form in use, showing movement of the charge train during a recharge cycle, wherein the bolt is positioned to its fully retracted position.
Figure 7:
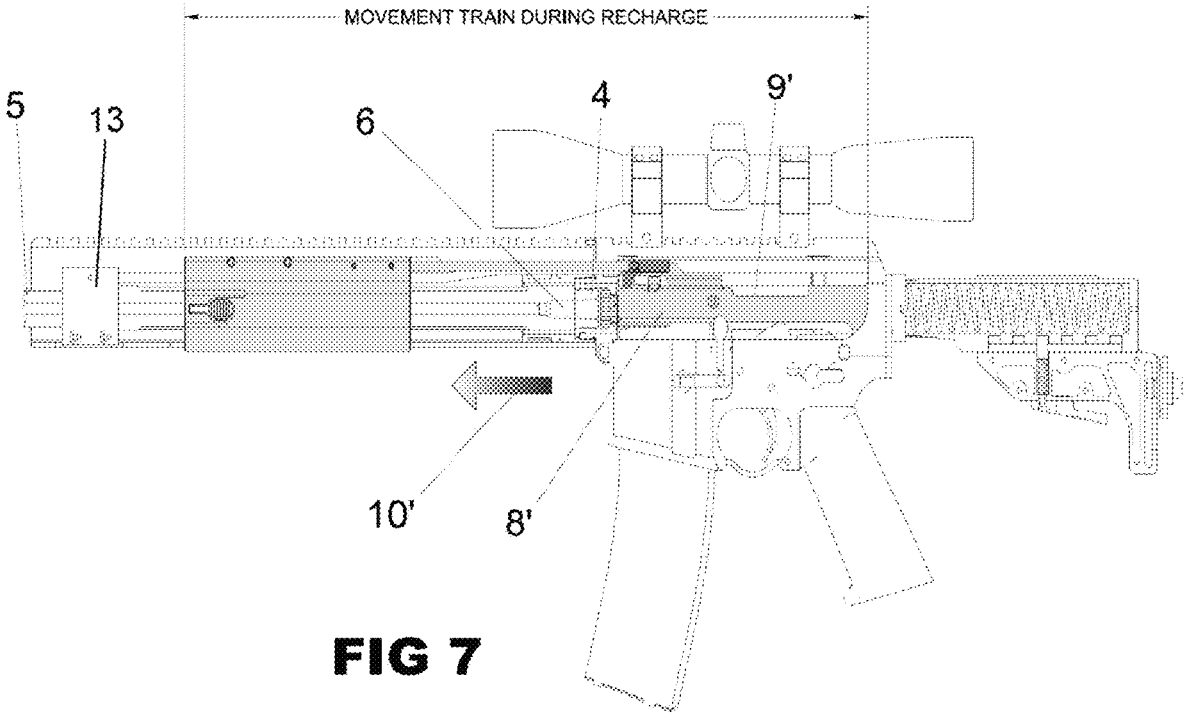
FIG. 7 is a side view of the invention of FIG. 6, instead showing movement of the charge train from the fully retracted position, urged via spring bias to the fully charged position with the bolt at the chamber.
Figure 8:
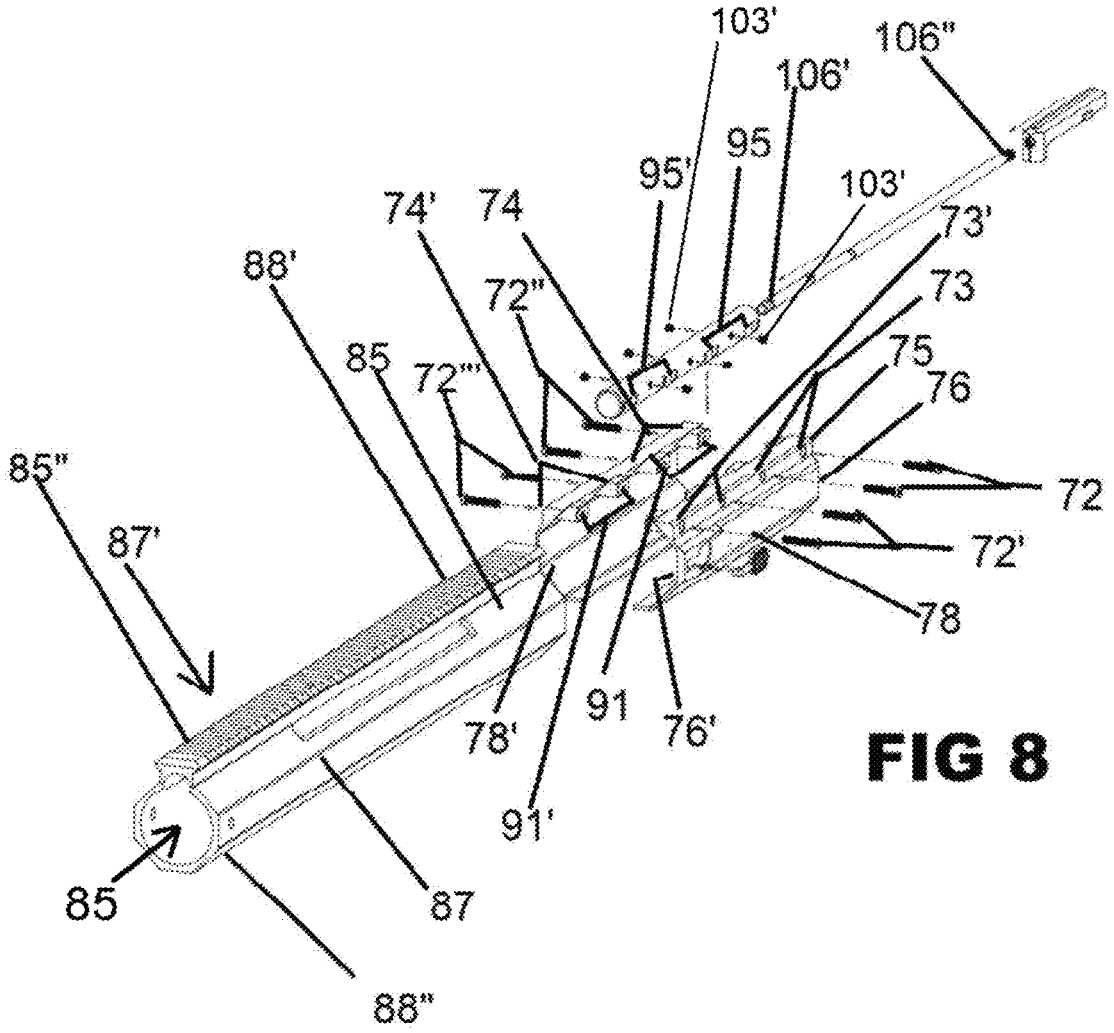
Figure 9:
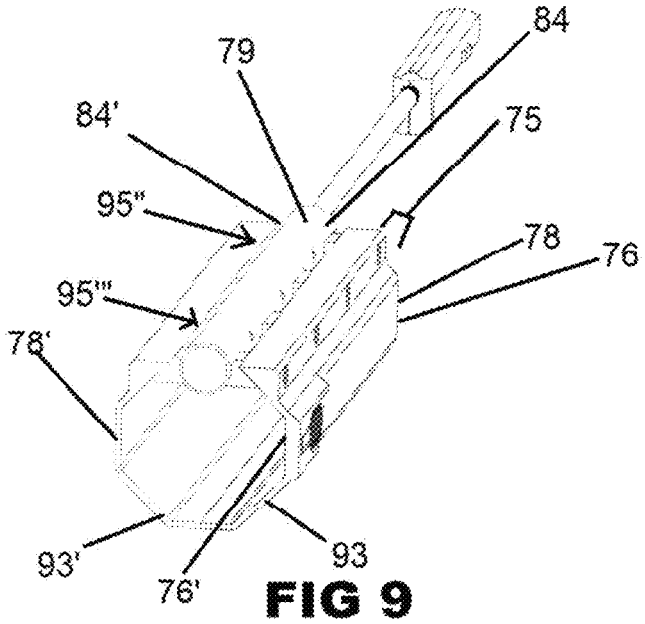
FIG. 9 is forward, perspective view of the assembled charging handle, drive stem and BCG catch of the invention of FIG. 8.
Figure 10:
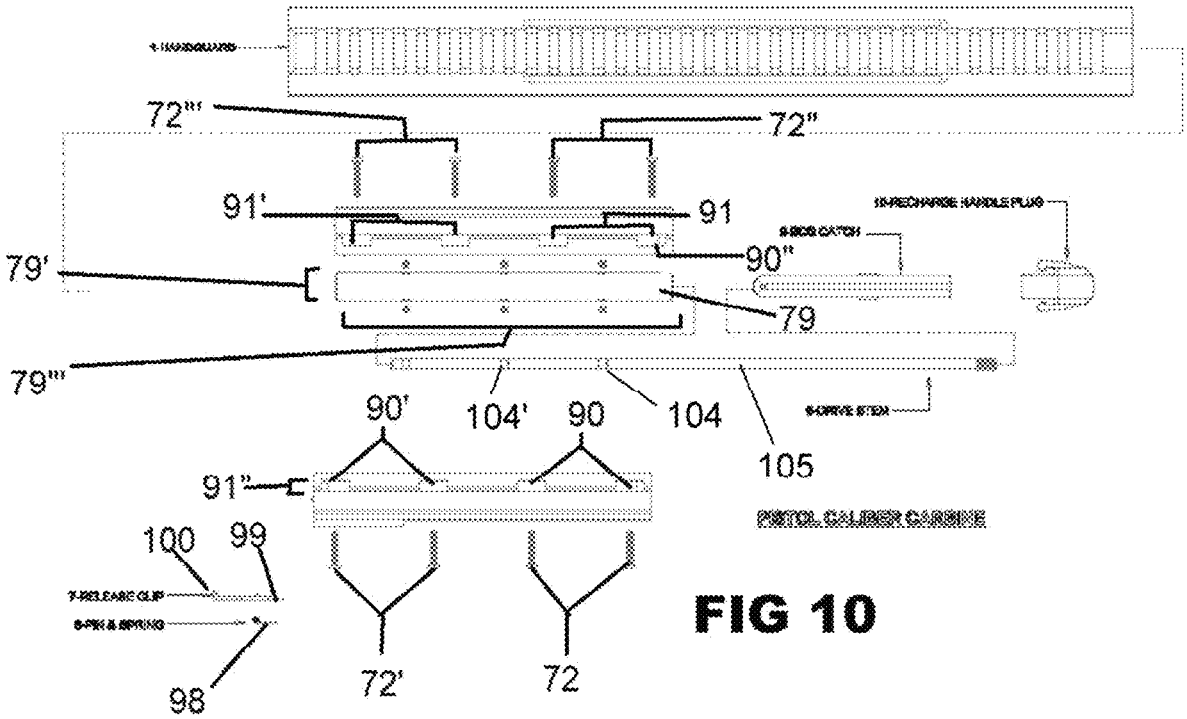
FIG. 10 is a top, exploded view of the invention of FIG. 8.
Figure 11:
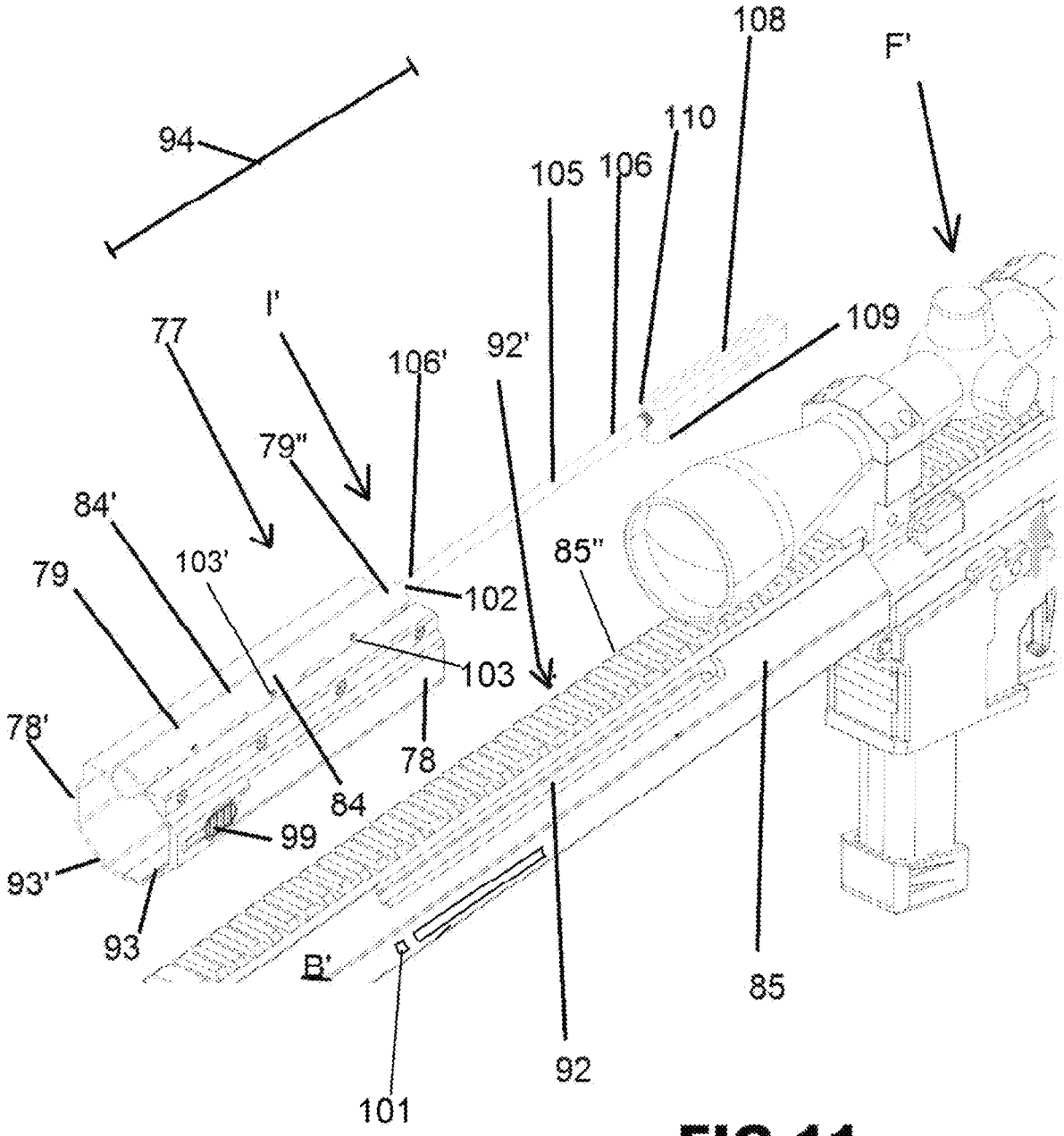
FIG. 11 is a forward, partial, perspective view of the invention of FIG. 10, illustrating the handguard applied to a pistol carbine, with the charging handle, drive stem and BCG catch of the present invention illustrated separately, prior to installation.
Figure 12:
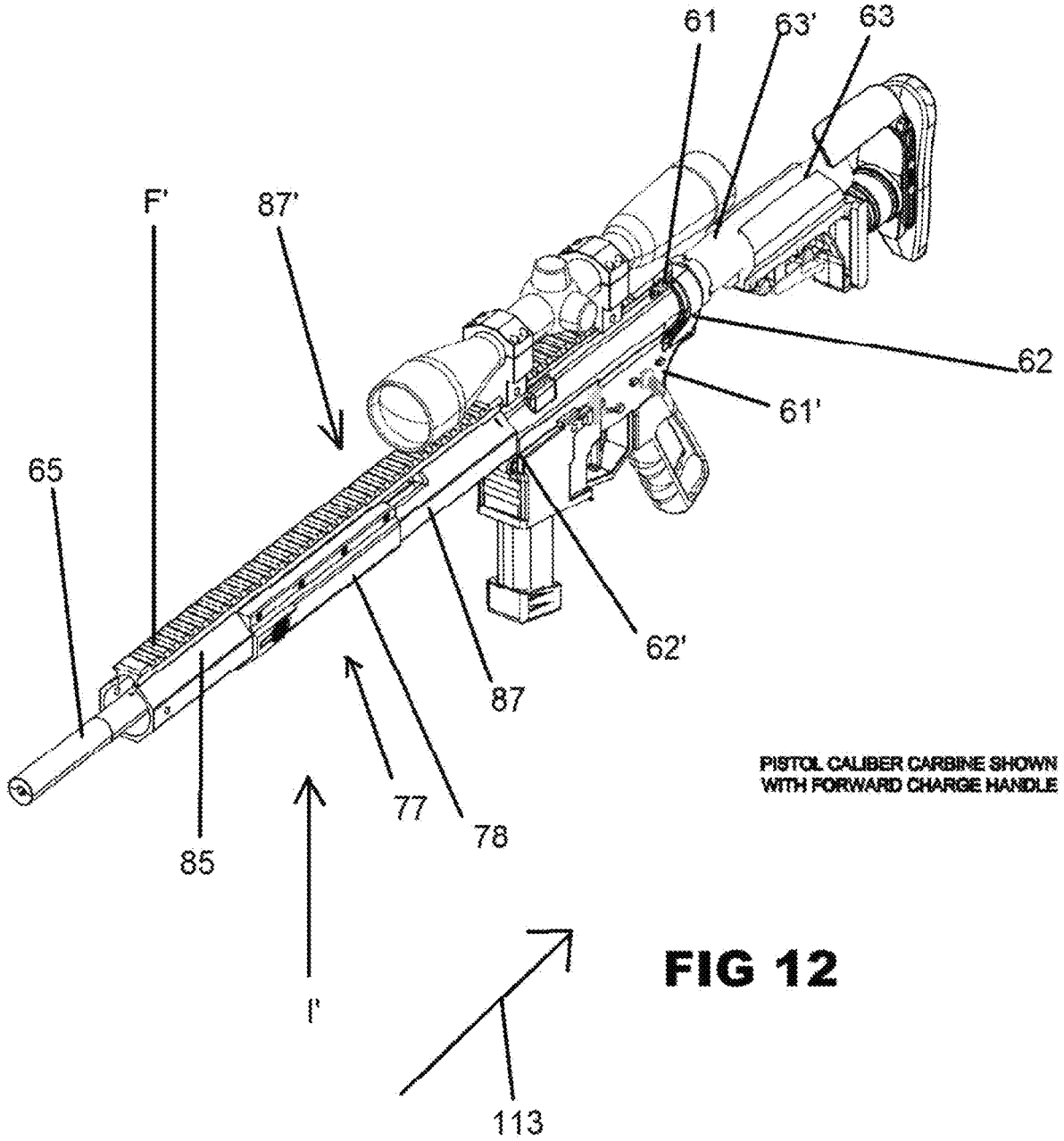
FIG. 12 is a forward, perspective view of the charging handle, drive stem and BCG catch of the invention of FIG. 11 shown in assembled form on a pistol caliber carbine.
Figure 13:
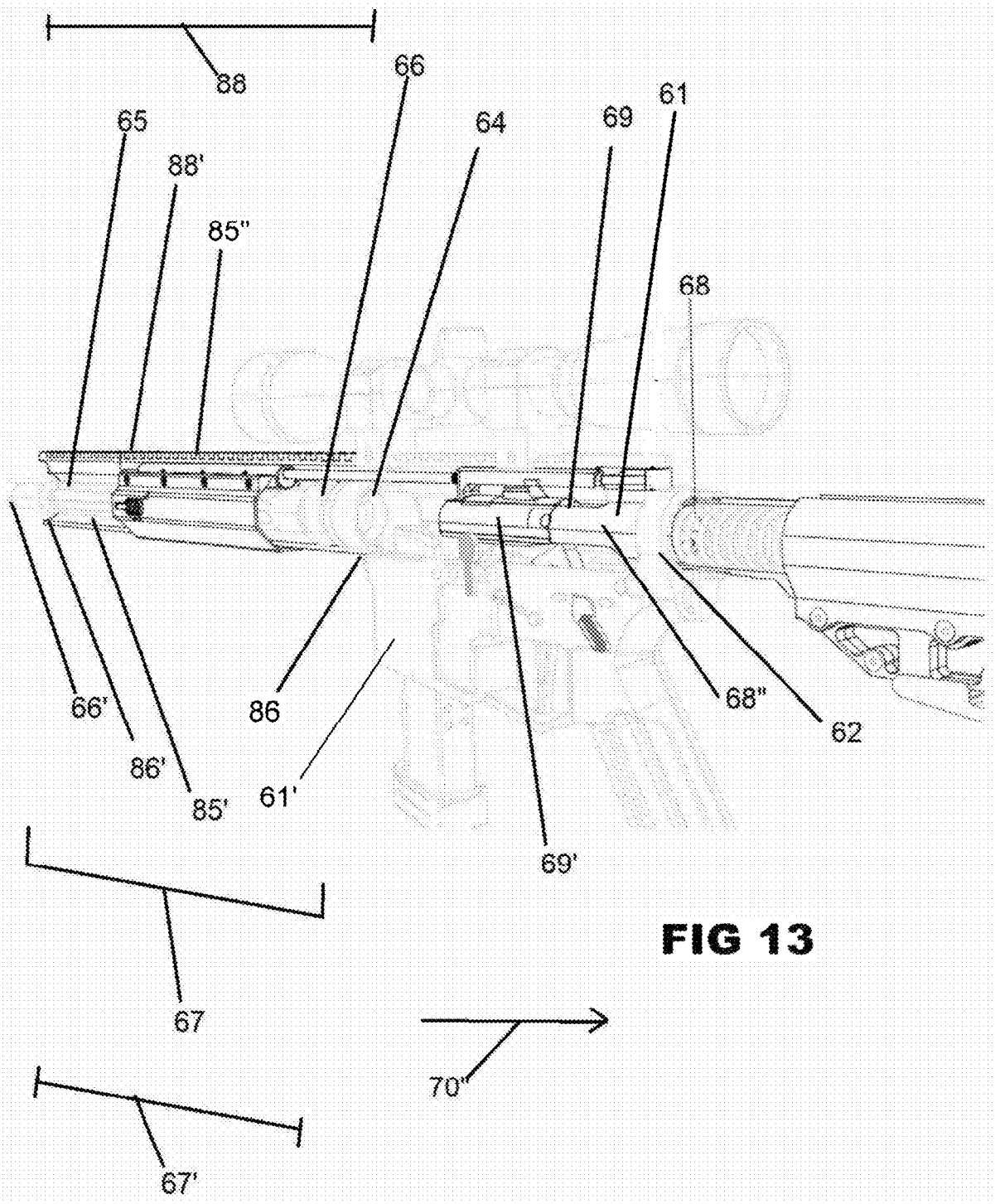
FIG. 13 is a side view of the invention of FIG. 12 in assembled form in use, showing movement of the charge train during the recharge cycle, wherein the bolt is positioned to its fully retracted position.
Figure 14:
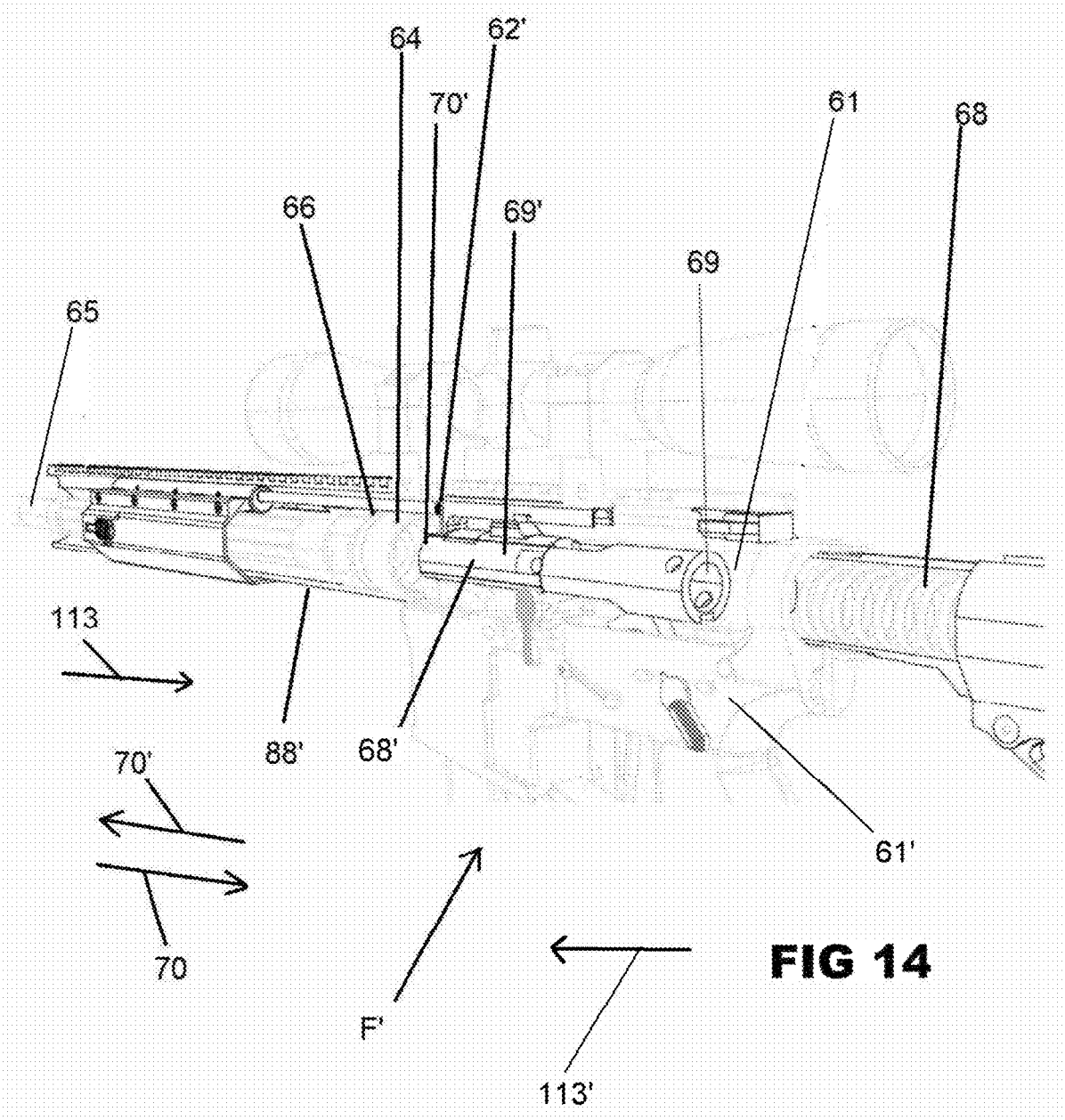
FIG. 14 is a side view of the invention of FIG. 13, but instead showing movement of the charge train from the fully retracted position, urged via spring bias to the fully charged position with the bolt at the chamber.
Figure 15:
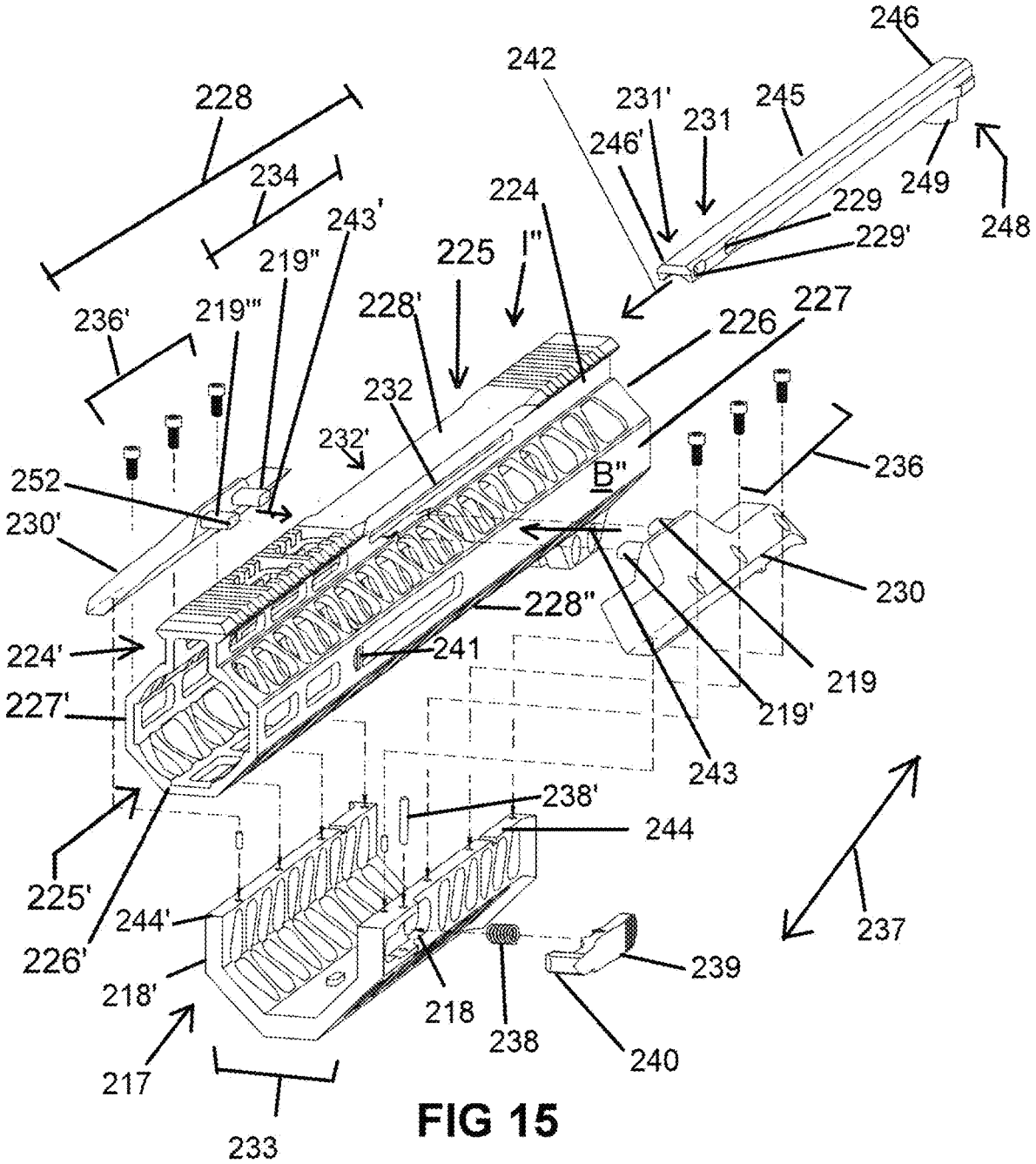
Figure 15A:
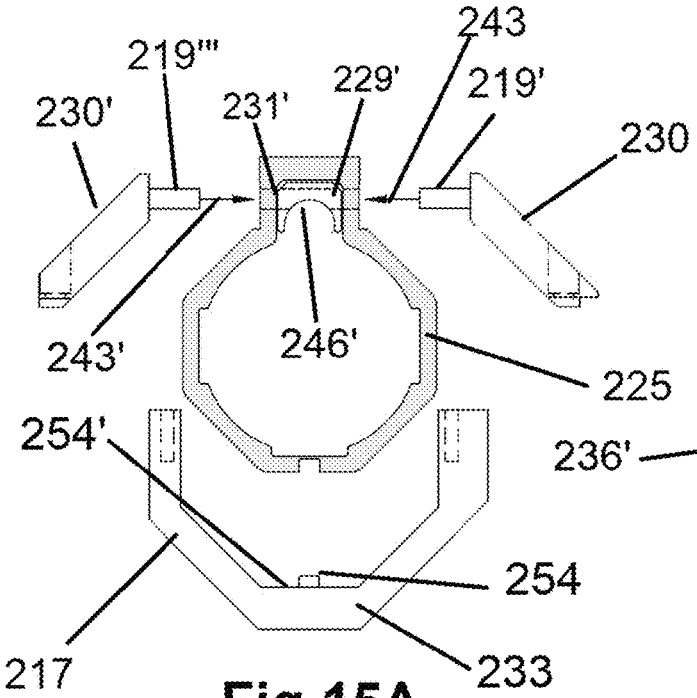
FIG. 15A is a front, partially cross-sectional, partially cut-away view of the invention of FIG. 15 illustrating the forward charging handle positioned to be mounted about the handguard with the opposing engagement brackets shown prior to being positioned to engage the drive stem.
Figure 15B:
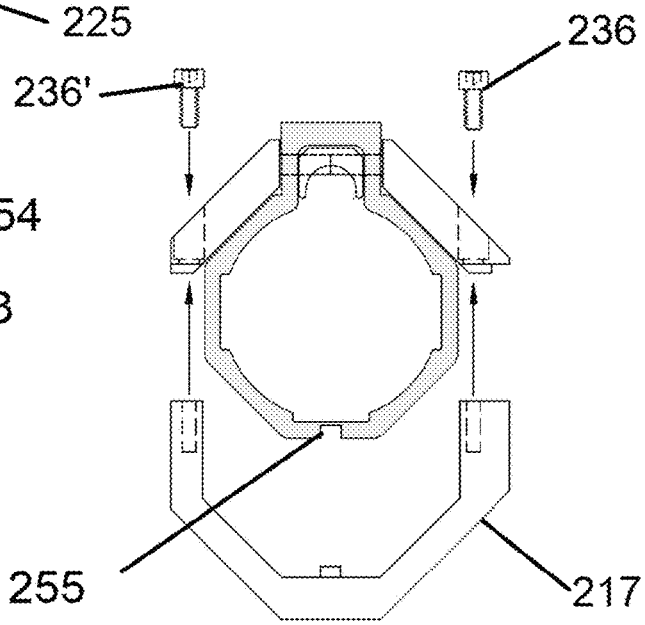
FIG. 15B is a front, partially cross-sectional, partially cut-away view of the invention of FIG. 15, with the mounting tabs of the opposing engagement brackets positioned to engage the second end of drive stem, with threaded fasteners shown for fastening the forward charging handle.
Figure 15C:
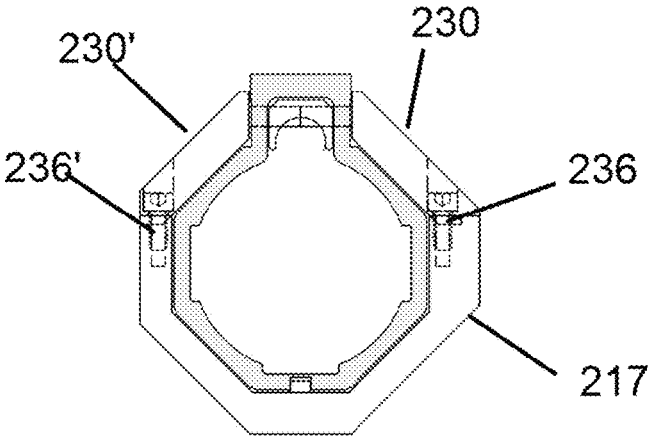
FIG. 15C is a front, partially cross sectional, partially cut-away view of the invention of FIG. 15B, illustrating the charging handled mounted about handguard and engaging the second end of drive stem via opposing engagement brackets, via said threaded fasteners.
Figure 16:
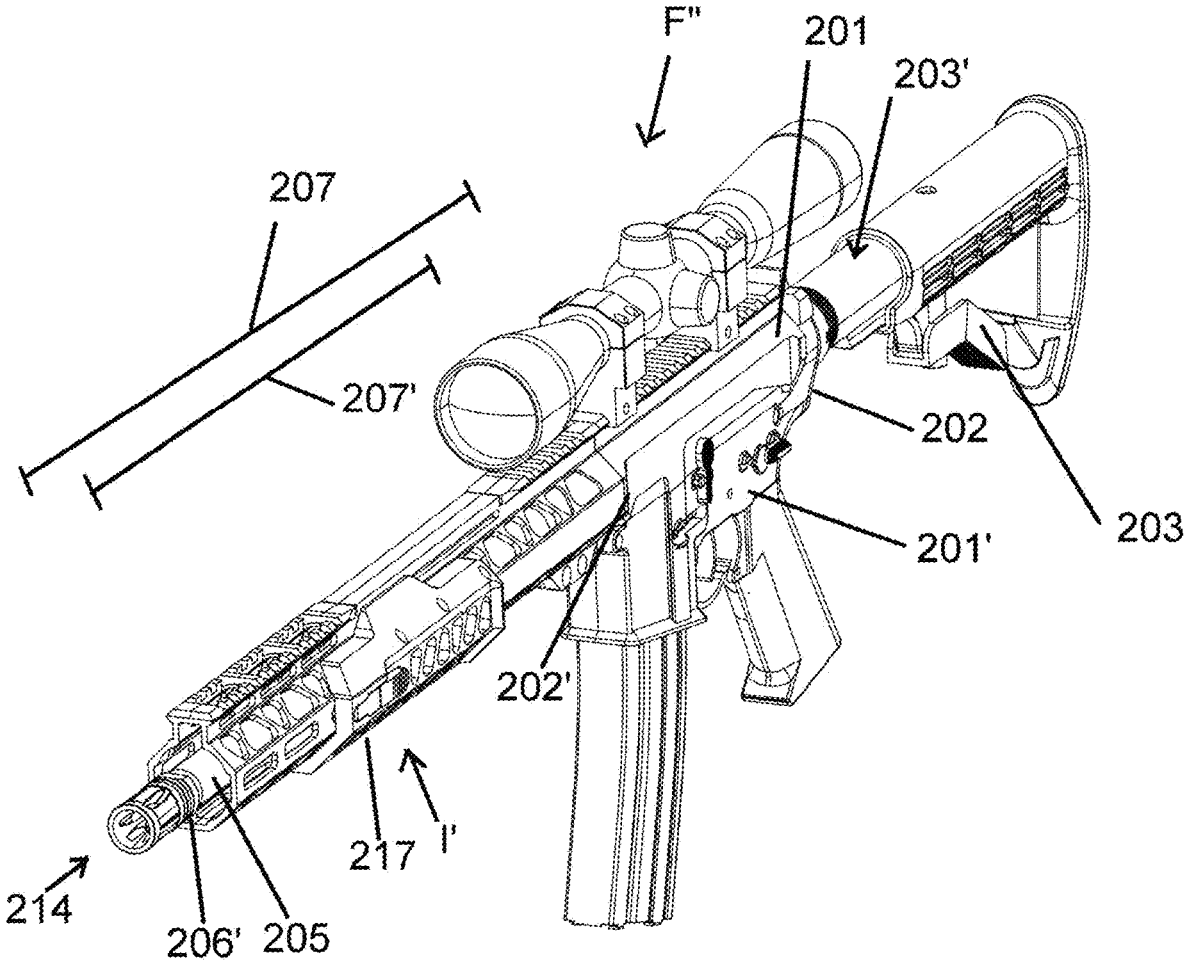
FIG. 16 is a forward, perspective view of the invention of FIG. 15, as applied to a AR-15 rifle.
Figure 17:
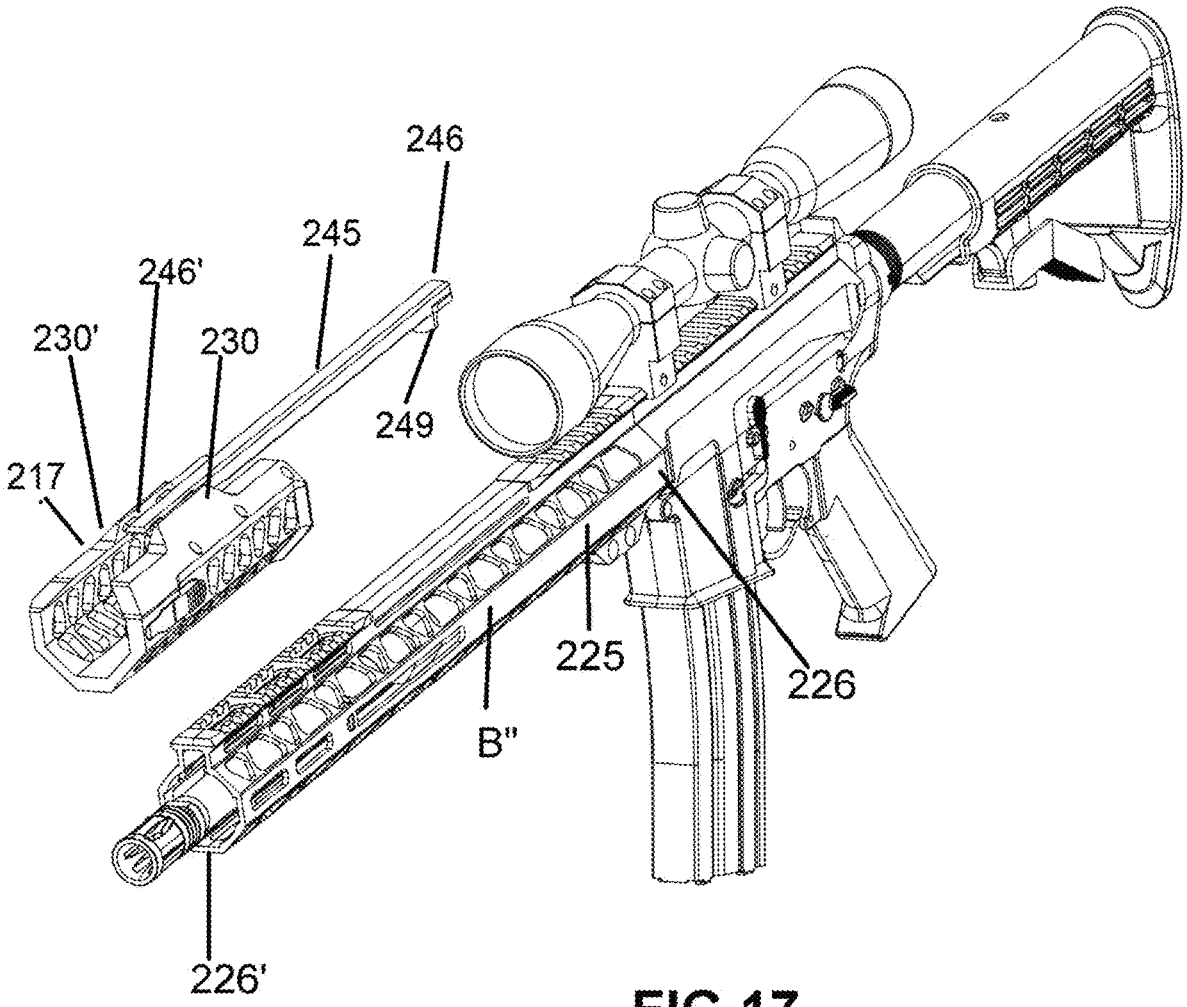
FIG. 17 is a forward, perspective view of the invention of FIG. 16, illustrating the handguard applied to the AR-15 with the charging handle, drive stem and BCG catch of the present invention illustrated separately prior to installation.
Figure 18:
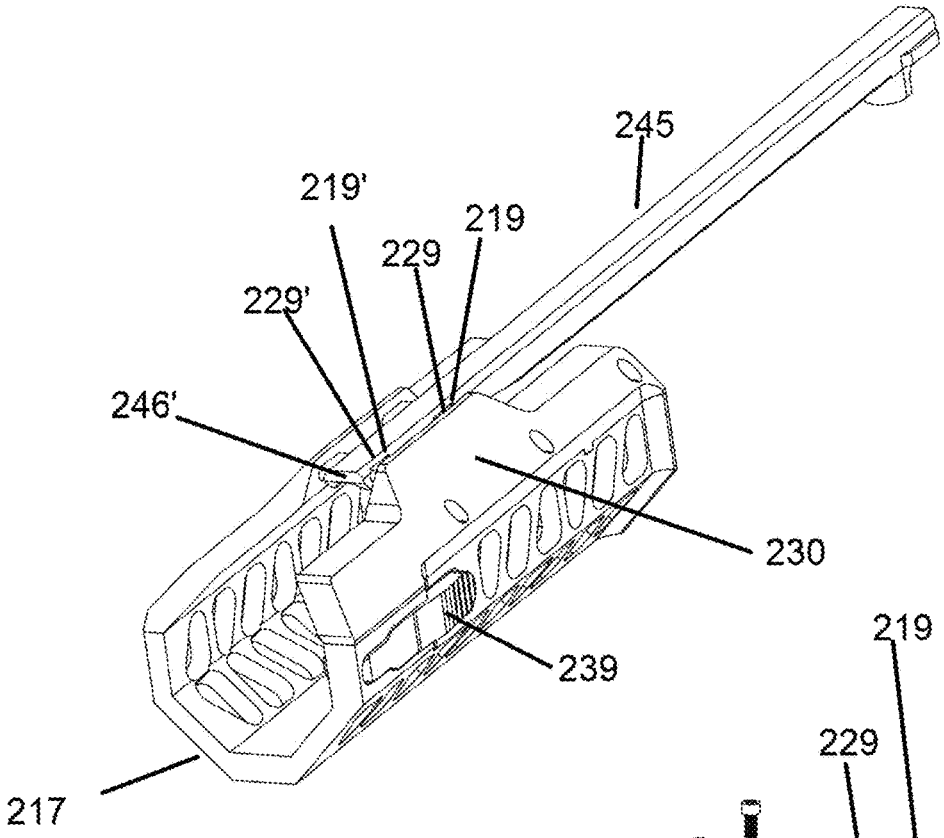
FIG. 18 is a forward, perspective view of the charging handle, drive stem and BCG catch of the invention of FIG. 17, shown in assembled form.
Figure 19:
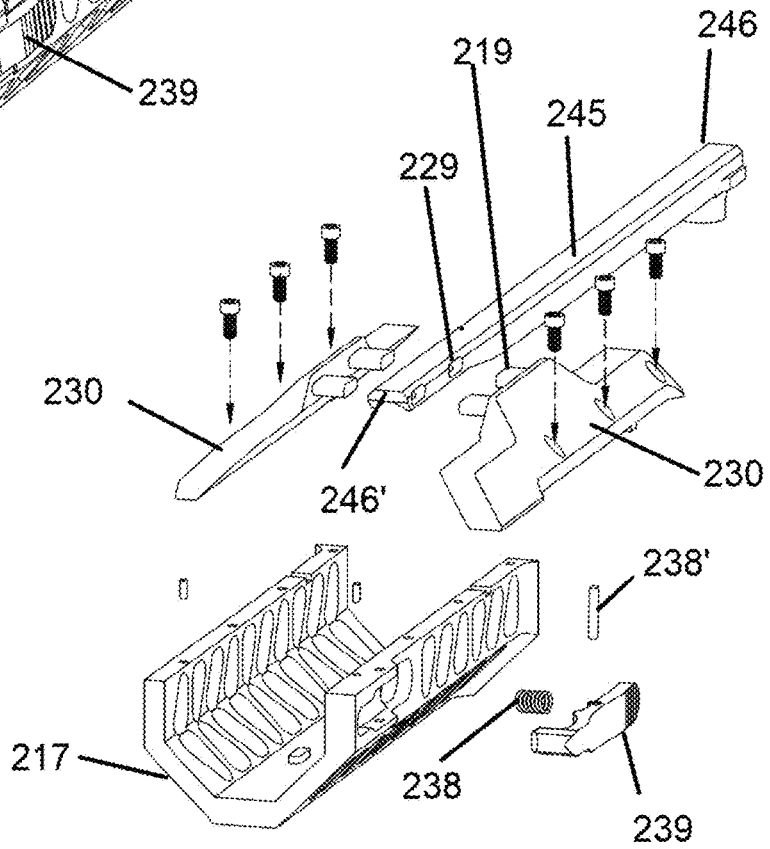
FIG. 19 is a forward, perspective, exploded view of the invention of FIG. 18.

Referring to FIGS. 1, 2, 3, 6 and 7, the preferred embodiment I of the present invention is configured for mounting to and use with a gas-operated, carbine-type firearm F using a gas tube as part of its operation, such as an AR15, M16 etc. As shown, the firearm illustrated has a lower receiver 1' and upper receiver 1. Each receiver 1, 1' has first 2, 2' and second ends, the first end 2 of lower receiver 1' having mounted thereto the tang or buffer tube 3' for a rear stock 3 (or other configuration, depending on type), the second end 2' of upper receiver 1 engaging a firing chamber 4 at the first end 6 of a barrel 5, the barrel 5 further comprising a second end 6' and a length 7 forming a longitudinal axis 7'.

A spring-biased 8 bolt carrier assembly 9 (also known as BCG) with bolt 9' is provided in the upper receiver 1 and is formed to slidably reposition 10 in longitudinal alignment 11 with the longitudinal axis 7' of barrel 5, from a chambered 10' position 8' with the bolt 9' engaging the chamber 4 at the first end 6 of barrel 5 at the second end 2' of upper receiver 1, to a recoiled 10" position 8" with the bolt spaced from the first end 6 of barrel 5, with the bolt carrier assembly 9 at the first 2 end of upper receiver 1.

For gas-operated carbines such as the AR15, M16 or the like, a gas tube 5' is utilized as part of its operation, the gas tube being generally longitudinally situated along the top of the barrel 5, the gas tube 5' having first and second ends, the second end provided to receive gas from the rifled bore 14 of barrel 5 via gas port 13 or the like, the first end providing flow of gas from discharged rounds in the rifle bore via gas port, through the gas tube 5', to the upper receiver 1.

Continuing with FIGS. 1-7, the preferred embodiment of the present invention I comprises a unique combination of a charging handle 17 and hand guard 25 which, in combination, is utilized to provide a pump-style charging action to the firearm F, as will be further discussed herein. The handguard 25 of the present invention as shown is specially configured for the present application, and replaces any prior handguard or forward stock which may have previously been mounted to firearm F.

The handguard 25 comprises an elongated main body B having a first 26 and second 26' ends having formed through its length a main passage 25' for receiving the barrel 5 and any gas tube 5' mounted thereto for the firearm F to which it is mounted, the handguard 25 further having a length 28, top 28', first 27 and second 27' sides, and bottom 28". First 30 and second 30' drive stem support tabs, each having drive stem passages 31, 31', respectively are situated at the first 27 and second 27' sides, respectively, of hand guard 25, at or near the first 26 end of hand guard 25.

As shown, the top 28' of the handguard 25 is spaced or elevated 35 away from the main body B via first 24 and second 24' extension walls, respectively emanating therefrom, which extension walls 24, 24' are parallel and equilaterally-spaced 35' relative to one another along main body B, the space 35' between first 24 and second 24' extension walls forming a secondary passage 24" therebetween. A rail mount 25" is shown situated provided along the top 28' of the handguard 25.

The charging handle 17 comprises first 18 and second 18' side panels 18, 18' respectively, which are situated in opposing, spaced relationship at opposing sides 27, 27' of handguard 25 respectively, as well as (in the present example) having bottom edges extending toward one another via first 33 and second 33' lower extensions, respectfully, so as to slidably envelope the underside or bottom 28" of handguard 25, said side panels 18, 18' joined via connection tab 19, the side panels 18, 18' when installed being situated about, while slidably reciprocating (via connection tab 19) along the length of handguard 25.

As shown connection tab 19 is a connection member formed to join first 18 and side 18' side panels in spaced relationship to one another in forming charging handle, providing a slidable engagement about handguard 25, which is fastened via threaded fasteners 36, 36', respectively.

Connection tab 19 slidably engages, is supported by and passes through first and second charging handle slots 32, 32' formed through first 24 and second 24' sidewalls respectively, said first and second charging handle slots 32, 32' having a width to receive the connection tab, said slots 32, 32' each further having a length 34 sufficient to provide sufficient reciprocation 37 for charging the bolt of firearm, said slots 32, 32' further longitudinally aligned with one another as well as the longitudinal axis 7' of the handguard 25 as well as the barrel 5 of firearm F.

Spring 38 biased (via retaining pin 38') release clip 39 having a pivotal catch 40 is mounted to first side panel 18, the catch formed to pivot via retaining pin to selectively engage (via spring bias) or disengage (via pressing release clip) locking aperture 41 formed in the side of handguard 25, so as to selectively lock or unlock the sliding/charging functionality in charging handle.

First 45 and second 45' drive stems, each having first 46 and second 46' ends, the first 46 end being threaded 46" are provided, the first 46 ends of drive stems 45, 45' threadingly engaging threaded apertures 50, 50' of BCG interface 48, respectively, which BCG interface 48 comprises a catch 49 for engaging the bolt carrier assembly 9 (BCA) or bolt carrier group (BCG) situated in the 1 upper receiver of firearm F.

The second end 46' of drive stems 45, 45' are formed to pass through the earlier referenced drive stem passages 31, 31' formed in first 30 and second 30' drive stem support tabs, respectively, so as to provide sliding engagement of same. The second ends 46' of drive stems 45, 45' comprises grooves 44, 44' respectively, spaced to receive set screws 51, 51' so as to engage same to side panels 18, 18' via drive stem passages 52, 52', respectively.

In use, the handguard 25 is mounted to the firearm F, with the forward charging handle 17 with side panels 18, 18', drive stems 45, 45', and BCG interface mounted as discussed so that the BCG catch 49 engages bolt carrier assembly 9.

If the pivotal catch 40 is engaged so as to lock the charging handle in position about handguard 25 via catch 40 engaging locking aperture 41, the user presses release clip 39 to pivot catch 40 to release the charging handle 17. The user then grasps the side panels 18, 18' forming the charging panel and pulls 53 same towards upper receiver 1, allowing BCG catch 49 to engage bolt carrier assembly 9 to fully retract from the firing chamber 4 at the first end 6 of barrel 5, then allows spring bias via spring 8 to return 53' bolt carrier assembly back to its position adjacent to firing chamber 4, along with forward charging handle including BCG interface to the previous position.

The present invention thereby provides a useful and effective system to forward charge a carbine or the like having a gas tube. As such a gas tube is typically situated along the top of the barrel within the handguard, the present invention provides the drive stem(s) so as to be situated exterior the handguard. In the present exemplary embodiment, as discussed above, the first and second drive stems being situated along opposing sides of the handguard, respectively.

Alternative Embodiment for Firearms without Gas Tube

FIGS. 8-14 illustrate an alternative embodiment of the invention of FIGS. 1-7, particularly suitable for firearms, such as pistol caliber carbines or the like.

Unlike firearms requiring a gas tube such as with the first embodiment, the present, alternative embodiment requires no gas tube, so the present invention can utilize the empty space provided above the barrel within the handguard to situate the drive stem, thereby enclosing the drive stem within the handguard. Other features of the present, alternative embodiment are similar to that of the first embodiment, as will be detailed below.

Referring to FIGS. 8-14, the alternative embodiment I' of the present invention is configured for mounting to and use with, for firearms F' NOT having a gas tube such as pistol caliber carbines, such as 9 mm, 38 cal, etc, the firearm F' illustrated having a lower receiver 61' and upper receiver 61, each receiver having first 62, 62' and second ends, the first end 62 of lower receiver 61' having mounted thereto the tang or buffer tube 63' for a rear stock 63 (or other configuration, depending on type), the second end 62' of upper receiver 61 engaging a firing chamber 64 at the first end 66 of a barrel 65, the barrel 65 further comprising a second end 66' and a length 67 forming a longitudinal axis 67'.

A spring-biased 68 bolt carrier assembly 69 (also referenced as a BCG) with bolt 69' is provided in the upper receiver 61 and is formed to slidably reposition 70 in longitudinal alignment with the longitudinal axis 67' of barrel 65, from a chambered 70' position 68' with the bolt 69' engaging the chamber 64 at the first end 66 of barrel 65 at the second end 62' of upper receiver, to a recoiled 70" position 68" with the bolt carrier assembly 69 with bolt 69' spaced from the first end 66 of barrel 65, with the bolt carrier assembly 69 at the first 62 end of upper receiver 61.

Continuing with the Figures, the present embodiment of the invention I' comprises a combination of a charging handle 77 and handguard 85 which, as with the preferred embodiment, in combination, is utilized to provide a pump-style charging action to the firearm F', but having different placement of the drive mechanism and as will be further discussed herein. The handguard 85 of the present invention as shown is specially configured and replaces any prior handguard or forward stock which may have previously been mounted to firearm F'.

The handguard 85 comprises an elongated main body B' having a first 86 and second 86' ends, the handguard further having formed through its length a main passage 85' for receiving the barrel 65 for the firearm F' to which it is mounted, the handguard 85 further having a length 88, top 88', first 87 and second 87' sides, and bottom 88". A rail mount 85" is shown situated provided along the top 88' of the handguard 85.

Handguard 85 has formed therein first and second charging handle slots 92, 92', forming an elongated opening through each of said first 87 and second 87' sidewalls respectively, said first and second charging handle slots 92, 92' having a length 94 sufficient to provide adequate reciprocation for charging the firearm, said slots 92, 92' further longitudinally aligned with one another as well as the longitudinal axis 67' of the handguard 85 as well as the barrel 65 of firearm F'.

The charging handle 77 is comprised of first and second side panels 78, 78' respectively, which are situated in opposing, spaced relationship at opposing sides 87, 87' of handguard 85 respectively, and are configured to envelope the sides of handguard. Further, side panels 78, 78' have bottom edges extending toward one another via first 93 and second 93' lower extensions, respectfully, so as to slidably envelope the underside or bottom 88" of handguard 85 as well.

Side panels 78, 78' each comprise outer 76 and inner 76' walls, and an upper section 75 through which there is formed fastener passages 73, 73' and 74, 74' respectively, along each panel's length. Each fastener passage extends through each panel and extends from the inner wall of each side panel via dowels 90, 90', and 91, 91' emanating therefrom, each dowel having a length 91" and free end 90" extending therefrom, each dowel having the respective extended fastener passage running therethrough.

A connection tube 79 is provided having a length 79'", width 79', first 79" and second ends and first 84 and second 84' sides, each side having one or more threaded passages 95, 95' and 95", 95'" situated along opposing sides respectively, each threaded passage spaced to align with respective fastener passages at the free ends of dowels engaging same, respectively.

The connection tube 79 forms a connection member and is slidably situated in main passage 85' of handguard 85, above barrel 65, so that the opposing threaded passages 95, 95' and 95", 95'" of connection tube are aligned to face handle opposing slots 92, 92' respectively, so that the free ends 90" of dowels 90, 90' and 91, 91' respectively are positioned to pass through slots 92, 92' so that threaded fasteners 72, 72' and 72", 72'" are used to fasten opposing side panels 78, 78' thereto.

First 78 and second 78' side panels are positioned in opposing, spaced relationship to one another to form the charging handle about the handguard 85, providing a slidable engagement about handguard 85, via the dowels emanating from the inner walls of said side panels 78, 78', and through said slots 92, 92' respectively to fasten same to opposing sides of said connection tube 79 situated within hand guard.

Said first 78 and second 78' side panels, having engaged said connection tube 79 via their respective dowels 90, 90' and 91, 91' respectively, thereby slidably engages, is supported by said hand guard via said slots 92, 92'.

Spring 98 biased release clip 99 has a pivotal catch 100 and is mounted to first side panel 78, the catch 100 formed to pivot to selectively engage (via spring bias) or disengage (via pressing release clip) a locking aperture 101 formed in the side of hand guard, so as to selectively lock or unlock the sliding/charging functionality in charging handle.

Drive stem 105 has first 106 and second 106' ends, the first 106 end being threaded 106", is provided, the first 106 end threadingly engaging threaded aperture 110 of BCG interface 108, which comprises a catch 109 for engaging the bolt carrier group (BCG) 69 (also known as bolt carrier assembly, i.e., BCA) situated in the upper receiver 61 of firearm F'.

The second end 106' of drive stem 105 engages aperture 102 at the first end 79" of connection tube 79 to the drive stem via fasteners 103, 103' seated in groove 104, 104', respectively, in drive stem 105, thereby linking the connection tube/side panels via the slots formed in the handguard.

In use, the handguard 85 is mounted to the firearm F', with the forward charging handle 77 with side panels 78, 78' engaging connection tube 79 via handguard slots 92, 92' the connection tube 79 linked to BCG interface mounted as discussed, via drive stem, so that the BCG catch engages bolt carrier assembly 69.

If the pivotal catch 100 is engaged so as to lock the charging handle in position about handguard 85, the user presses release clip 99 to pivot catch 100 to release the charging handle 77 (formed by opposing side panels 78, 78'). The user then grasps the opposing side panels 78, 78' and pulls 113 same towards upper receiver 61, allowing BCG catch 109 to engage bolt carrier assembly 69 to fully retract from the firing chamber 64 at the first end 66 of barrel 65, then allows spring bias via spring 68 to return 113' bolt carrier assembly back to its position adjacent to firing chamber 64, along with forward charging handle including BCG interface to the previous position.

Second, Latest Alternative Embodiment for Firearms with or without a Gas Tube

Referring to FIGS. 15-21, a second alternative embodiment I" of the present invention is configured for mounting to and use with a gas-operated, carbine-type firearm F" using a gas tube as part of its operation, such as an AR15, M16 etc. Alternatively, as discussed herein, a slight variation of the present invention may be utilized with automatic or semi-automatic firearms not employing a gas tube.

As shown, the firearm illustrated has a lower receiver 201' and upper receiver 201. Each receiver 201, 201' has first 202, 202' and second ends, the first end 202 of lower receiver 201' having mounted thereto the tang or buffer tube 203' for a rear stock 203 (or other configuration, depending on type), the second end 202' of upper receiver 201 engaging a firing chamber 204 at the first end 206 of a barrel 205, the barrel 205 further comprising a second end 206', the first and second ends forming a length 207 having a longitudinal axis 207'.

A spring-biased 208 bolt carrier assembly 209 (also known as BCG) with bolt 209' is provided in the upper receiver 201 and is formed to slidably reposition 210 in longitudinal alignment 211 with the longitudinal axis 207' of barrel 205, from a chambered 210' position 208' with the bolt 209' engaging the chamber 204 at the first end 206 of barrel 205 at the second end 202' of upper receiver 201, to a recoiled 210" position 208" with the bolt spaced from the first end 206 of barrel 205, with the bolt carrier assembly 209 at the first 202 end of upper receiver 201.

For gas-operated carbines such as the AR15, M16 or the like, a gas tube 205' is utilized as part of its operation, the gas tube being generally longitudinally situated along the top of the barrel 205, the gas tube 205' having first and second ends, the second end provided to receive gas from the rifled bore 214 of barrel 205 via gas port 213 or the like, the first end providing flow of gas from discharged rounds in the rifle bore via gas port, through the gas tube 205', to the upper receiver 201.

Continuing with FIGS. 15-21, the present alternative embodiment I" of the invention comprises a unique combination of a charging handle 217 and hand guard 225 which, in combination, is utilized to facilitate a pump-style charging action to the firearm F", as will be further discussed herein. The handguard 225 of the present invention as shown is specially configured for the present application, and replaces any prior handguard or forward stock which may have previously been mounted to firearm F".

The handguard 225 comprises an elongated main body B" having a first 226 and second 226' ends having formed through its length a main passage 225' for receiving the barrel 205 and any gas tube 205' mounted thereto for the firearm F" to which it is mounted, the handguard 225 further having a length 228, top 228', first 227 and second 227' sides, and bottom 228".

As shown, the top 228' of the handguard 225 is spaced or elevated 235 away from the main body B" via first 224 and second 224' extension walls, respectively emanating therefrom, which extension walls 224, 224' are parallel and equilaterally-spaced 35' relative to one another along main body B", the space 235' between first 224 and second 224' extension walls situated about and elevated above the barrel 205 and any gas tube 205' or the like which may be present, so as to form a secondary passage 224" between the walls 224, 224' respectively and 228' or handguard 225. A rail mount 225" is shown situated provided along the top 228' of the handguard 225.

Continuing with FIGS. 14-21, the charging handle 217 comprises first 218 and second 218' side panel sections, which are situated in opposing, spaced relationship to be positioned along opposing sides 227, 227' of handguard 225 respectively. The side panels 218, 218' are joined via a medially situated lower section 233 situated therebetween, said lower section 233 formed to be situated along the underside or bottom 228" of handguard, respectively. A ridge 254 is provided on the inside wall 254' of lower section 233, formed to slidingly interface with groove 255 formed in the bottom 228" or underside of handguard 225, to provide a secure, non-rattling (and thereby quiet), slidable engagement of said charging handle about said handguard, as further discussed herein.

A drive stem 245 is provided having first 246 and second 246' ends. Said second end 246' of drive stem has formed therein tab passages 229, 229' and 231, 231' situated in the vicinity of its second end 246'. Said second end 245 is inserted 242 into the secondary passage 224" at the first end 226 of handguard 225 and aligned with said slots 232 to receive mounting tabs associated with said charging handle, as will be further detailed herein.

First and second engagement brackets 230, 230', respectively, are provided having upper ends angled toward one another and having emanating therefrom two sets of mounting tabs 219, 219' and 219", 219'", oriented toward one another, respectively, said mounting tabs positioned 243, 243' so that their free ends 252 pass through first and second slots 232, 232' respectively formed in first and second sidewalls 224, 224', respectively, and into first 229, 229' and second 231, 231' tab passages of said drive stem 245, engaging same, at which point said first 218 and second 218' side panels of said charging handle 217, via its free upper edges 244, 244' are engaged to via threaded fasteners 236, 236' said first and second engagement brackets 230, 230' respectively, providing an installed charge handle engaging said drive stem 245 via said first 232 and second 232' slots of said handguard 225, providing a slidable engagement about handguard 225, with said slots 232, 232' each having a length 234 sufficient to provide sufficient reciprocation 237 for charging the bolt of firearm, said slots 232, 232' further longitudinally aligned with one another as well as the longitudinal axis 207' of the handguard 225 as well as the barrel 205 of firearm F.

Spring 238 biased release clip 239 having a pivotal catch 240 is mounted (via retaining pin 238') to first side panel 218, the catch formed to pivot via retaining pin to selectively engage (via spring bias) or disengage (via pressing release clip) locking aperture 241 formed in the side of handguard 225, so as to selectively lock or unlock the sliding/charging functionality in charging handle.

The first 246 end of drive stem 245 comprises a BCG interface 248 having a catch 249 formed to selectively engage a shoulder 256 or the like formed in the bolt carrier assembly 209 (BCA) or group (BCG) situated in the upper receiver 201 of firearm F".

As shown, the catch 249 selectively engages the bolt carrier group 209 by urging same away from the chamber when the user pulls the forward charging handle 217 as will be discussed further herein. Catch 249 as shown is preferably has for use with gas-operated firearms having a gas tube, as it includes an aperture 247' formed in the catch 249 to allow the key 247 associated with the bolt carrier group 209 to interface with and receive gas from the gas tube upon discharge of the weapon, although the present invention also contemplates a catch without the aperture 247' for use with non-gas operated automatic or semi-automatic weapons or the like, as will be discussed infra.

In use, the handguard 225 is mounted to the firearm F", with the forward charging handle 217 with drive stems 245 mounted thereto as discussed so that, upon grasping and pulling same, the BCG catch 249 selectively engage bolt carrier assembly 209 (BCA) shoulder 256 using a pushing force to urge it away from the chamber (without being affixed or attached to the BCA), so as to clear the chamber or facilitate loading of same, while allowing the BCA to independently cycle upon firing without engaging the BCG catch during the firing cycle.

Continuing with the figures, if the pivotal catch 240 is engaged so as to lock the charging handle in position about handguard 225 via catch 240 engaging locking aperture 241, the user presses release clip 239 to pivot catch 240 to release the charging handle 217. The user then grasps charging handle 217 and pulls 253 same towards upper receiver 201, allowing BCG catch 249 to engage bolt carrier assembly 209 to fully retract from the firing chamber 204 at the first end 206 of barrel 205, then allows spring bias via spring 208 to return 253' bolt carrier assembly back to its position adjacent to firing chamber 204, along with forward charging handle including BCG interface to the previous position.

Accordingly, the BCG or bolt carrier assembly as configured will to cycle away from said firing chamber upon discharge of said firearm independent of said drive stem, as said drive stem is not affixed to said BCG, and said charging handle, which is connected to said drive stem, is typically locked in place to render same immovable when the charge handle is not being used to retract clear or load the chamber via retracting the BCG, as discussed supra.

Figure 20:
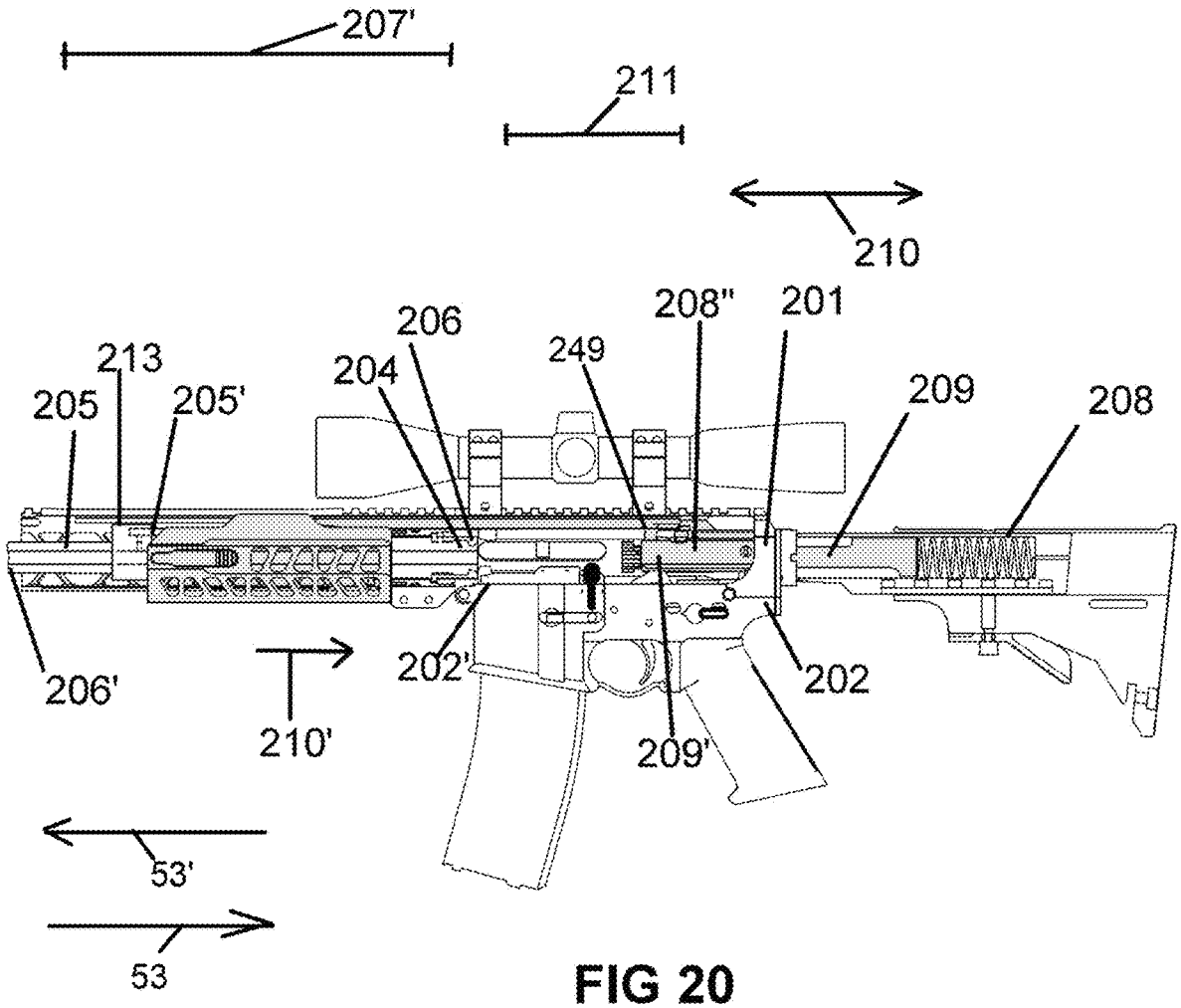
FIG. 20 is a side view of the invention of FIG. 17 in assembled form in use, showing movement of the charge train during a recharge cycle, wherein the bolt is positioned to its fully retracted position.
Figure 20A:
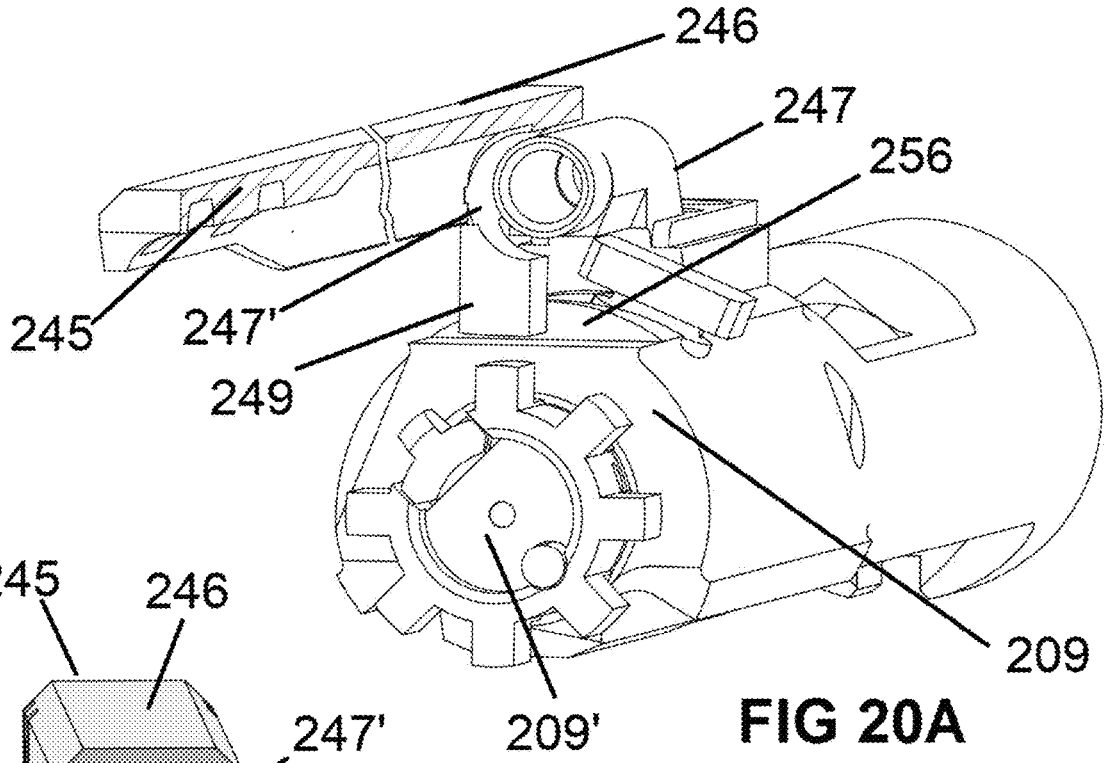
FIG. 20A is a side, perspective, partial, partially cut-away, close-up view of the present invention of FIG. 20, illustrating the second end of drive stem with the bolt carrier key aperture formed in the drive stem catch for passage of gas tube therethrough for gas-operated firearms.
Figure 20B:
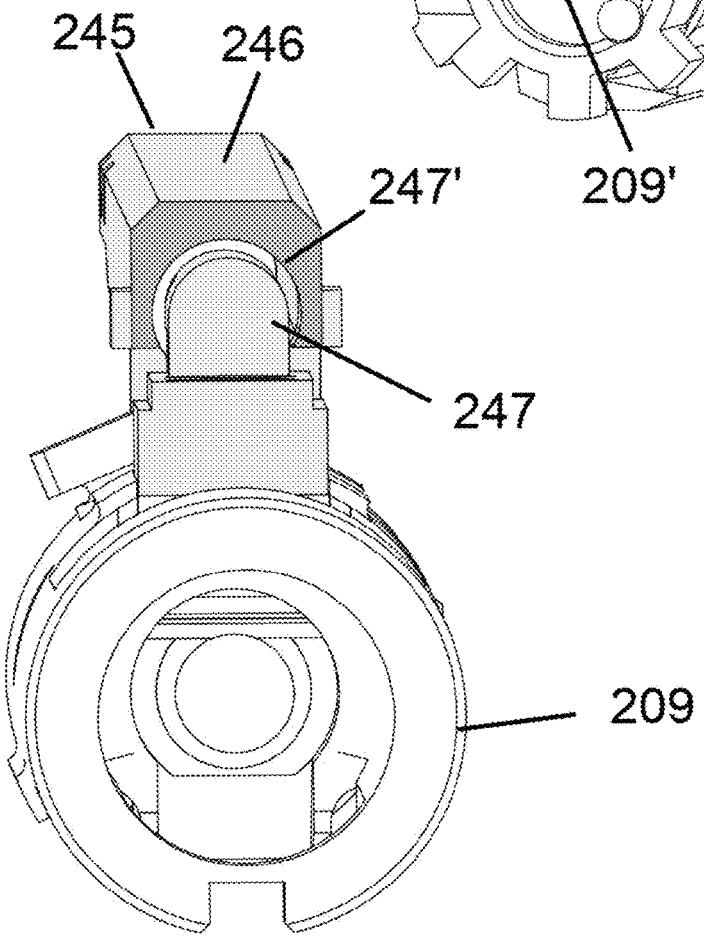
FIG. 20B is a rear view of the invention of FIG. 20A, illustrating the second end of drive stem with drive stem catch with aperture formed for passage for gas tube therethrough, and rear of bolt carrier key.
Figure 20C:
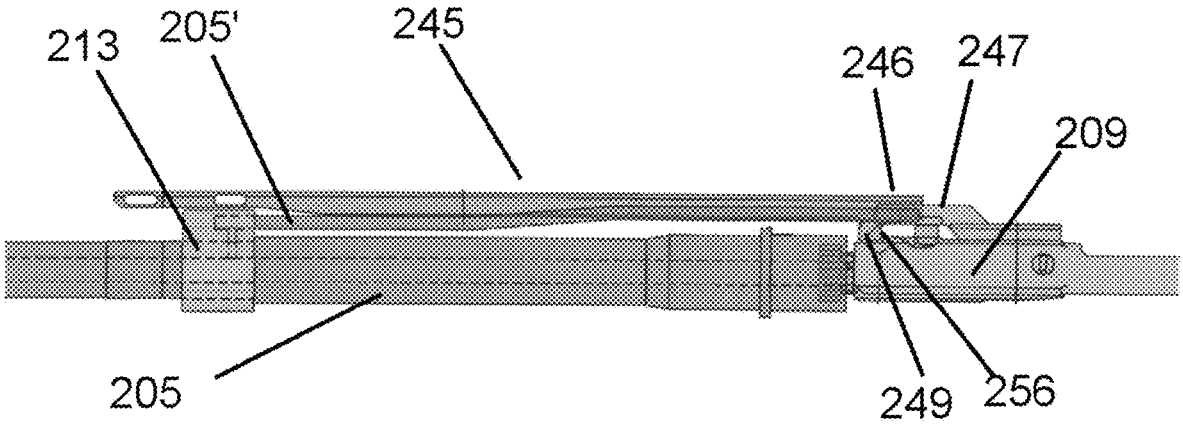
FIG. 20C is a partial, cutaway, side-view of the invention of FIG. 20A, illustrating a view of a barrel of a gas-operated firearm with chamber, gas block with gas tube engaging the BCG gas key, and drive stem of the present invention situated along/above the gas tube, with the drive stem catch engaging the BCG shoulder, as well as the gas tube passing therethrough via aperture formed in the drive stem catch.
Figure 21:
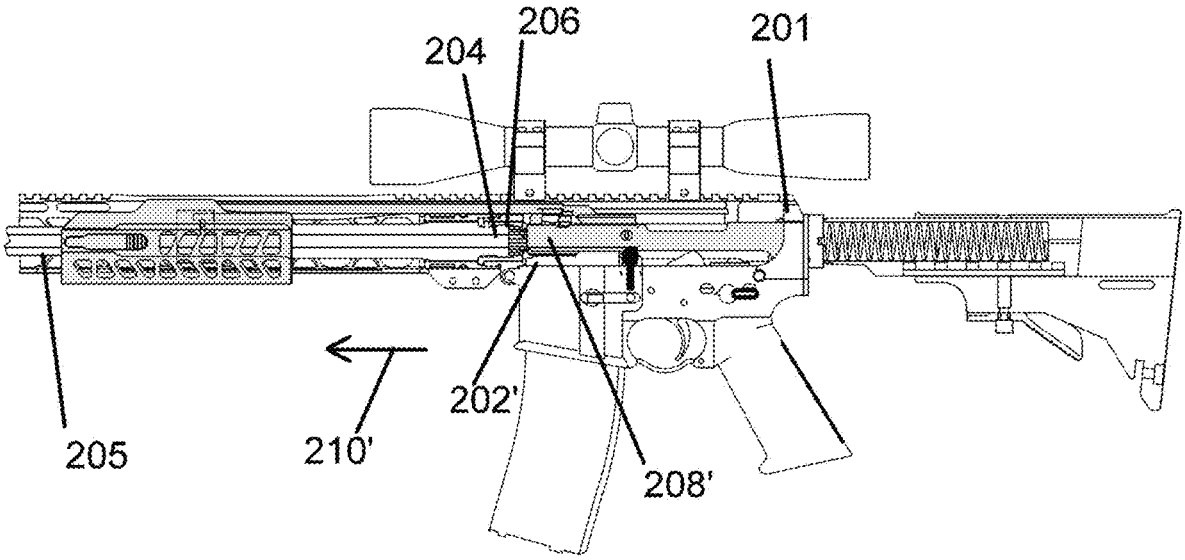
FIG. 21 is a side view of the invention of FIG. 20, instead showing movement of the charge train from the fully retracted position, urged via spring bias to the fully charged position with the bolt at the chamber.

The present invention thereby provides a useful and effective system to forward charge a carbine or the like having a gas tube 205'. In a typical gas-operated firearm, the gas tube 205' would be situated along the top of the barrel 205 within the handguard. The present invention provides an innovative drive stem 246 formed to be situated along at least some of the length of the gas tube (FIGS. 20A-20C), the drive stem 246 having at its first end a BCG catch 249 including an aperture 247' formed therethrough so as to allow the passage therethrough of an end of the gas tube and/or bolt carrier key 247 so they can selectively interconnect during operation of the firearm, in a configuration wherein the drive stem 246 situated interior the handguard and thereby hidden and isolated from the user.

Based upon the above, a method of the present invention may be summarized as follows:

method of charging a firearm having a barrel having a chamber, a receiver, and spring-biased bolt carrier assembly, comprising:

a) enveloping at least a portion of said barrel of said firearm with a handguard having first and second opposing sides, a bottom, and a length, at least one of said first and second sides having formed therethrough a slot aligned with said length of said firearm;

b) providing a drive stem having a length and first and second ends, said first end providing a catch formed to selectively engage said bolt carrier assembly;

c) positioning said drive stem situated within said handguard so that said catch engages said bolt carrier assembly;

d) providing a charging handle formed to slidingly envelope at least a portion of said handguard, said charging handle formed engage said drive stem via said slot formed along said handguard;

e) grasping said charging handle and sliding same along said hand guard toward said receiver, while utilizing said catch to push against, without being attached to, said bolt carrier assembly, positioning said block carrier assembly away from said chamber.

f) of utilizing said spring-bias to urge said bolt carrier assembly back to said chamber.

Finally, the present invention is suitable for implementation with firearms NOT having a gas tube such as pistol caliber carbines, such as 9 mm, 38 cal, etc, the firearm F'. In such an embodiment, the charge handguard dimensions may be adjusted as no gas tube would be utilized, and as such no bolt carrier key would be required, so the BCG catch 249 in such an embodiment would NOT require an aperture 247' as shown in the figures.

ELEMENTS OF THE INVENTION

I,',",'" preferred, alternative embodiments of invention
F,' firearm
B,' main body of handguard 25
1,' upper, lower receiver
2,' first, second ends
3,' stock, buffer tube
4 firing chamber
5,' barrel, gas tube
6,' first, second ends
7,' length, longitudinal axis
8,',," spring biased, chambered, recoiled position
9,' bolt carrier assembly or group (BCG), bolt
10,',," reposition, chambered, recoiled
11 longitudinal alignment
13 gas port
14 rifle bore
17 forward charging handle
18,' first and second side panels
19 connection tab
24,',," first, second extension/sidewalls, secondary passage
25,',' handguard, main passage, rail mount
26,' first, second ends
27,' first, second sides
28,',," length, top, bottom
30,' drive stem support tabs
31,' drive stem passages
32,' first, second slots for charging handle
33,' first, second lower extensions
34 length
35,' elevated, spaced
36,' threaded fasteners for tab 19
37 reciprocation
38,' spring, retaining pin
39 release clip
40 pivotal catch
41 locking aperture
44', grooves to receive set screws
45,' drive stems
46,',," first, second, ends, threaded ends
48 BCG interface
49 BCG catch
50,' BCG drive stem threaded apertures
51,' drive stem set screws
52,' drive stem apertures
53,' pulls, returns
61,' upper, lower receiver
62,' first, second ends
63,' stock, tang or buffer tube
64 firing chamber
65 barrel
66,' first, second ends
67,' length, longitudinal axis
68,',," spring biased, chambered, recoiled position
69,' bolt carrier assembly, bolt
70,',," reposition, chambered, recoiled
72,',",'" fasteners
73,' fastener passages
74,' fastener passages
75 upper edge/section
76,' outer, inner walls side panels
77 forward charging handle
78,' first and second side panels
79,',",'" connection tube, width, first end, length
84,' first second sides connection tube
85,',," handguard, main passage, rail mount
86,' first, second ends
87,' first, second sides
88,',," length, top, bottom
90,',," dowels, free end
91,',," dowels, length
92,' first, second slots for charging handle
93,' first, second lower extensions
94 length
95,',",'" connection tube fastener passages
98 spring
99 release clip
100 pivotal catch
101 locking aperture
102 connection tube end aperture for drive stem
103,' set screws for setting drive stem
104,' grooves to receive set screws
105 drive stem
106,',," first, second, ends, threaded ends
108 BCG interface
109 BCG catch
110 BCG drive stem threaded apertures
113,' pulls, returns
201,' upper, lower receiver
202,' first, second ends
203,' stock, buffer tube
204 firing chamber
205,' barrel, gas tube
206,' first, second ends
207,' length, longitudinal axis
208,',," spring biased, chambered, recoiled position
209,' bolt carrier assembly or group (BCG), bolt
210,',," reposition, chambered, recoiled
211 longitudinal alignment

213 gas port
214 rifle bore
217 forward charging handle
218,' first and second side panels
219,',",'" mounting tabs
224,',," first, second extension/sidewalls, secondary passage
225,',," handguard, main passage, rail mount
226,' first, second ends
227,' first, second sides
228,',," length, top, bottom
229.' first tab passages
230,' opposing engagement brackets
231,' second tab passages
232,' first, second slots for charging handle
233 lower section
234 length
235,' elevated, spaced
236,' fasteners
237 reciprocation
238,' spring, retaining pin
239 release clip
240 pivotal catch
241 locking aperture
242 inserted
243,' positioned
244,' upper edges
245 drive stem
246,' first, second ends
247,' bolt carrier key, aperture
248 BCG interface
249 BCG catch
250,' first tabs
251,' second tabs
252 tips
253,' pulls, returns
254,' ridge, inside wall of lower section
255 groove
256 BCG shoulder The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense. Accordingly, the use of various terms herein such as, but not limited to, "tab" and/or "tube" should not be considered limiting as to any particular configuration, except as specifically described herein.

I claim:

1. An apparatus for charging a firearm having a barrel, a receiver, and a bolt carrier assembly, comprising:

a handguard enveloping at least a portion of said barrel, said handguard having first and second opposing sides, a bottom, and a length, said bottom of said handguard having a groove formed along at least a portion of said length of said handguard;

a slot formed through one of said opposing sides of said handguard, said slot aligned with said length of said handguard;

a drive stem having a length and first and second ends, said drive stem having formed at said first end a catch formed to selectively engage said bolt carrier assembly, said drive stem situated within said handguard;

a charging handle formed to slidingly envelope at least a portion of said first and second opposing sides and said bottom of said of said handguard, said charging handle formed to engage said drive stem via said slot, said charging handle having a lower section comprising an inside wall having a ridge, said charging handle formed to envelope said opposing sides and said bottom of said handguard so as to facilitate sliding motion of said charging handle along at least a portion of said length of said handguard with said ridge situated in said groove of said handguard, so as to provide enhance stabilization of movement of said charging handle in relation to said handguard;

whereby, upon grasping said charging handle and sliding same along said handguard toward said receiver, said catch is formed to push against, without being attached to, said bolt carrier assembly, so as to urge said bolt carrier assembly away from said chamber.

2. The apparatus of claim 1, wherein said firearm has a gas tube situated along said barrel to said bolt carrier assembly, and wherein said length of said drive stem is situated along said gas tube, within said handguard.

3. The apparatus of claim 2, wherein said bolt carrier assembly has a gas key, and wherein said catch of said drive stem has formed therethrough a passage formed to allow the passage therethrough of said gas key or said gas tube therethrough.

4. The apparatus of claim 3, wherein said bolt carrier assembly has formed thereon a shoulder, and wherein said catch of said drive stem is formed to engage said shoulder of said bolt carrier assembly without being affixed thereto.

5. The apparatus of claim 4, wherein there is provided a pivotal catch mounted to said charging handle, said pivotal catch formed to engage said handguard to selectively lock said charging handle at a predetermined position along said handguard.

6. The apparatus of claim 5, wherein said pivotal catch pivots on a retaining pin and is spring biased to urge said pivotal catch in a locked position.

7. The apparatus of claim 6, wherein said pivotal catch is formed to lock upon engagement with a locking aperture formed along said handguard.

8. The apparatus of claim 3, wherein said charging handle further comprises first and second opposing sides, and wherein said slot formed in said handguard comprises a first slot associated with said first side of said handguard, and wherein there is further provided along said second side of said handguard a second slot, and wherein said first and second opposing sides of said charging handle are formed to engage said drive stem via said first and second slots formed along said handguard, respectively.

9. The apparatus of claim 3, wherein said bolt carrier assembly of said firearm is spring-biased such that, upon grasping said charge handle and sliding same along said handguard toward said receiver via said slots, positioning said bolt away from said chamber; and allowing said spring-bias to urge said bolt to said chamber.

10. The method of charging a firearm having a barrel having a chamber, a receiver, and a spring-biased bolt carrier assembly, comprising:

a) enveloping at least a portion of said barrel of said firearm with a handguard having first and second opposing sides, a bottom, and a length, at least one of said first and second sides having formed therethrough a slot aligned with said length of said firearm, said bottom of said handguard having a groove formed along at least a portion of said length of said handguard;

b) providing a drive stem having a length and first and second ends, said first end providing a catch formed to selectively engage said bolt carrier assembly;

c) positioning said drive stem situated within said handguard so that said catch engages said bolt carrier assembly;

d) providing a charging handle formed to slidingly envelope at least a portion of said opposing sides and said bottom of said handguard, said charging handle formed to engage said drive stem via said slot;

e) providing in said charging handle a lower section comprising an inside wall having a ridge formed to engage said groove formed along said bottom of said handguard, said charging handle formed to envelope said opposing sides and said bottom of said handguard so as to facilitate sliding motion of said charging handle along at least a portion of said length of said handguard with said ridge situated at least partially in said groove, so as provide enhanced stabilization of movement of said charge handle in relation to said handguard;

f) grasping said charging handle and sliding same along said handguard toward said receiver, while utilizing said catch to push against, without being attached to, said bolt carrier assembly, positioning said bolt carrier assembly away from said chamber.

11. The method of claim 10, wherein there is provided after step "f" the added step "g" of utilizing said spring-bias to urge said bolt carrier assembly back to said chamber.

* * * * *